US008210079B2

(12) United States Patent
Myers et al.

(10) Patent No.: US 8,210,079 B2
(45) Date of Patent: Jul. 3, 2012

(54) PROGRAMMABLE BORDER SLITTER

(75) Inventors: Terrance L. Myers, Carl Junction, MO (US); Jeff Kaetterhenry, Davie, FL (US); Ivan Habek, Ivanek (HR); Stjepan Vadlja, Cakovec (HR)

(73) Assignee: L&P Property Management Company, South Gate, CA (US)

( * ) Notice: Subject to any disclaimer, the term of this patent is extended or adjusted under 35 U.S.C. 154(b) by 656 days.

(21) Appl. No.: 12/464,457

(22) Filed: May 12, 2009

(65) Prior Publication Data

US 2010/0218658 A1 Sep. 2, 2010

Related U.S. Application Data

(63) Continuation-in-part of application No. 12/209,441, filed on Sep. 12, 2008, now abandoned.

(60) Provisional application No. 60/990,457, filed on Nov. 27, 2007, provisional application No. 60/972,466, filed on Sep. 14, 2007.

(51) Int. Cl.
*B26D 1/14* (2006.01)

(52) U.S. Cl. ..... 83/498; 83/504; 83/508.1

(58) Field of Classification Search ..... 83/407, 83/498, 499, 500, 501, 502, 504, 508.1, 508.2, 83/508.3, 156, 174, 331, 425.4, 436.15, 436.7, 83/436.75, 481

See application file for complete search history.

(56) References Cited

U.S. PATENT DOCUMENTS

| | | | | |
|---|---|---|---|---|
| 2,885,920 | A | | 5/1959 | Livingston |
| 3,084,839 | A | | 4/1963 | Aronson |
| 4,151,770 | A | * | 5/1979 | D'Angelo et al. ..... 83/262 |
| 4,280,386 | A | | 7/1981 | Ward, Sr. |
| 4,649,782 | A | | 3/1987 | Cavagna |
| 4,680,851 | A | | 7/1987 | Legg |
| 5,083,489 | A | | 1/1992 | Tidland et al. |
| 5,154,130 | A | | 10/1992 | Gribetz et al. |
| 5,165,314 | A | | 11/1992 | Paulson et al. |
| 5,239,904 | A | | 8/1993 | Yamaguchi et al. |
| 5,535,656 | A | | 7/1996 | Pummell et al. |
| 5,544,599 | A | | 8/1996 | Frazer et al. |
| 5,720,210 | A | | 2/1998 | Okahashi |
| 5,761,980 | A | | 6/1998 | Ima et al. |
| 6,105,520 | A | | 8/2000 | Frazer et al. |
| 6,165,117 | A | * | 12/2000 | Adami ..... 493/365 |
| 6,237,517 | B1 | | 5/2001 | Bondanza et al. |
| 6,286,404 | B1 | | 9/2001 | Miglietta |

(Continued)

FOREIGN PATENT DOCUMENTS

WO 2009036258 3/2009

*Primary Examiner* — Stephen Choi
(74) *Attorney, Agent, or Firm* — Wood, Herron & Evans, LLP

(57) ABSTRACT

An apparatus for feeding and slitting soft goods has multiple slitting systems with respective slitting blades mounted on a cross rail. A slitting blade positioning system is movable parallel with the cross rail and operable to move slitting systems along the cross rail. A material feed motor is connected to a feed roller and operable to move the soft goods past the slitting system. A control is first operable to cause the slitting blade positioning system to move identified slitting systems to desired positions on the cross rail. Thereafter, the control operates a drive shaft motor to rotate slitting blades mounted on the drive shaft and the material feed motor, thereby moving the soft goods past the slitting blades.

32 Claims, 35 Drawing Sheets

U.S. PATENT DOCUMENTS

| | | | | |
|---|---|---|---|---|
| 7,134,372 | B2 * | 11/2006 | Flaherty et al. | 83/425.4 |
| 2003/0209115 | A1 * | 11/2003 | Burkart et al. | 83/13 |
| 2004/0149105 | A1 | 8/2004 | Michalski | |
| 2004/0221699 | A1 | 11/2004 | Adachi et al. | |
| 2005/0211031 | A1 | 9/2005 | James et al. | |
| 2006/0179989 | A1 | 8/2006 | James et al. | |
| 2008/0264222 | A1 * | 10/2008 | Dobrescu et al. | 83/176 |
| 2009/0071305 | A1 | 3/2009 | Myers et al. | |

* cited by examiner

22b

PROGRAMMABLE BORDER SLITTER

CROSS REFERENCE TO RELATED APPLICATIONS

This application is a continuation-in-part of to U.S. Patent application Ser. No. 12/209,441 filed Sep. 12, 2008 now abandoned entitled "Programmable Border Slitter", which is fully incorporated herein. U.S. patent application Ser. No. 12/209,441 claims the benefit of the filing date of U.S. Provisional Patent Application Ser. No. 60/990,457, filed Nov. 27, 2007 which is fully incorporated herein. U.S. patent application Ser. No. 12/209,441 further claims the benefit of the filing date of U.S. Provisional Patent Application Ser. No. 60/972,466, filed Sep. 14, 2007 which is fully incorporated herein.

FIELD

This invention relates generally to cutting flat soft goods and, more particularly, to feeding and slitting a wide piece of material. The invention is particularly useful for slitting border pieces forming edges of mattress covers and other quilted soft goods.

BACKGROUND

In the manufacture of bedding, a mattress cover is often comprised of upper and lower panels that are often fabricated from layers of different soft goods. Such mattress cover panels are typically made on wide-width multi-needle quilting machines and associated panel cutters such as those described in U.S. Pat. Nos. 5,154,130, 5,544,599 and 6,237,517, all hereby expressly incorporated by reference herein. The upper and lower panels are separated by a border piece that forms the sides of a mattress and extends around the full perimeter of the panels. Multiple mattress border pieces are often cut from a single, wide piece of fabric on a border slitting machine having multiple slitting blades in parallel across a width of the slitting machine.

One or more manual operations are required with known border slitting machines. For example, prior to slitting border pieces, the slitting blades must be manually positioned at desired locations. The positioning operation requires that the slitting blades be unlocked, for example, by loosening a locking screw, manually moved to new positions across the width of the slitting machine and then, manually locked at the new positions. Further, the slitting blades may require manual sharpening. In addition, after the border pieces are slit, the border pieces may then be manually cut to a desired length. The above manual operations are labor intensive, relatively slow and time-consuming, which substantially increases costs associated with the manufacture of the border pieces.

Further, with known border slitting machines, the slitting blades are mounted on a common drive shaft that extends across the width of the slitting machine. Thus, replacement of a slitting blade requires the removal of all of the slitting blades that are closer to an end of the support shaft. Again, the required removal of multiple slitting blades to replace a single slitting blade is labor intensive, time-consuming and requires the slitting machine be out of production. Thus, replacing a slitting blade reduces the efficiency of the slitting operation and substantially adds to its cost.

Therefore, there is a need for an improved border slitting machine that is more automated and efficient.

SUMMARY

The present invention provides a programmable border slitter that is fully automated and eliminates known manual operations. The programmable border slitter automatically positions and sharpens the slitting blades; and further, slit border pieces are automatically cut to length. In addition, the slitting blades are individually mounted and thus, replaceable without having to remove other slitting blades. Thus, the programmable border slitter may be operated continuously, is very efficient and border pieces can be manufactured in substantially less time.

According to certain embodiments, an apparatus for feeding and slitting soft goods has multiple rollers including feed and pinch rollers that carry the soft goods. A cross rail is generally parallel to but spaced from the rollers; and multiple slitting systems with respective slitting blades are mounted on the cross rail. A slitting blade motor is operably connected to a slitting blade. A slitting blade positioning system is movable parallel with the cross rail, and the slitting blade positioning system is operable to move a slitting system over a substantial length of the cross rail and thus, a substantial width of the soft goods. A material feed motor is connected to the feed roller and operable to move the soft goods past the slitting system. A control is connected to the slitting blade motor, the slitting blade positioning system and the material feed motor, and the control is first operable to cause the slitting blade positioning system to move the slitting system to a desired position on the cross rail. The control is further operable to turn on the slitting blade motor and the material feed motor, thereby moving the soft goods past the slitting blade.

According to another aspect, the slitting blade positioning system may have a carriage mounted parallel to the cross rail; and the control causes the carriage to move a slitting system to a desired position on the cross rail. In an alternative embodiment, the slitting blade positioning system may have positioning motors mounted on respective slitting systems; and the positioning motors are operable by the control to independently move the respective slitting systems to desired positions along the cross rail.

In a further aspect, the slitting blades are rotated by a common blade drive motor; and in an alternative embodiment, each slitting system has a blade drive motor connected to a respective slitting blade. In yet other aspects, a blade sharpener is mounted adjacent the slitting systems; and the slitting blade positioning system is used to move a slitting system adjacent the blade sharpener to sharpen a slitting blade. In an alternative embodiment, a blade sharpener is mounted on each slitting system and operable by the control to sharpen a respective slitting blade. In a further embodiment, a blade sharpener is mounted on a drive system to be moved parallel to the cross rail; the blade sharpener is movable by the control to a position adjacent a slitting blade to be sharpened.

In a still further aspect, a cross cutter system is connected to the control for cutting slit soft goods to a desired length.

In one of the embodiments, the apparatus for feeding and slitting soft goods comprises a plurality of rollers adapted to carry the soft goods, the plurality of rollers comprising a feed roller and a pinch roller. The apparatus further comprises a cross rail extending generally parallel to but spaced from the plurality of rollers and a plurality of slitting blade assemblies movably mounted on the cross rail, the slitting blade assemblies comprising respective slitting blades mounted on a rotatable drive or slitting blade shaft. A drive shaft motor rotates the drive shaft. The apparatus further comprises a slitting blade positioning system movable in a direction parallel with the cross rail, the slitting blade positioning system being operable to identify and move a slitting blade assembly to a desired position relative to the cross rail. A material feed motor is connected to the feed roller and operable to move the soft goods past the slitting blade assembly. Lastly, a control operates the drive shaft motor, the slitting blade positioning system and the material feed motor, the control being operable to cause the slitting blade positioning system to move the slitting blade assembly to a desired position on the cross rail, and the control being further operable to turn on the drive shaft motor and the material feed motor, thereby moving the soft goods past the slitting blade.

In another embodiment, the apparatus for feeding and slitting soft goods comprises a plurality of rollers adapted to carry the soft goods, the plurality of rollers comprising a feed roller and a pinch roller. A cross rail extends generally parallel to, but spaced from, the plurality of rollers. A plurality of slitting blade assemblies are mounted for sliding motion on the cross rail, each of the slitting blade assemblies comprising a rotatable slitting blade rotatable with respect to the remainder of the slitting blade assembly. A rotatable drive shaft is mounted generally parallel to, but spaced from the cross rail, the drive shaft operably connected to the slitting blades. A drive shaft motor is operable to rotate the drive shaft and the slitting blades. A slitting blade positioning system is mounted on and movable in a direction parallel with the cross rail, the slitting blade positioning system being operable to move the slitting blade assemblies along the cross rail and thus, across a substantial width of the soft goods. A material feed motor is connected to the feed roller and operable to move the soft goods past at least some of the slitting blade assemblies. A control operates the drive shaft motor, the slitting blade positioning system and the material feed motor, the control operable to cause the slitting blade positioning system to move the slitting blade assemblies to desired respective positions on the cross rail, and the control being further operable to turn on the drive shaft motor and the material feed motor, thereby moving the soft goods past the slitting blades.

In another embodiment, the apparatus for feeding and slitting soft goods comprises a plurality of rollers adapted to carry the soft goods, the plurality of rollers comprising an engagement roller movable by a pair of pneumatic members. A cross rail extends generally parallel to, but spaced from, the plurality of rollers. Slitting blade assemblies are movable in a direction generally parallel to the cross rail, each of the slitting blade assemblies comprising a plurality of metal cams and having a rotatable slitting blade mounted on a drive shaft mounted on a drive shaft motor. A slitting blade positioning system is mounted on and movable in a direction parallel with, the cross rail, the slitting blade positioning system being operable to move the slitting blade assemblies over a substantial length of the cross rail and thus, a substantial width of the soft goods. A material feed motor is connected to one of the rollers and operable to move the soft goods past at least one of the slitting blade assemblies. A control operates the drive shaft motor, the slitting blade positioning system and the material feed motor, the control being operable to cause the slitting blade positioning system to move the slitting blade assemblies to desired respective positions on the cross rail, and the control being further operable to turn on the drive shaft motor and the material feed motor, thereby moving the soft goods past the rotating slitting blades.

These and other objects and advantages of the present invention will become more readily apparent during the following detailed description taken in conjunction with the drawings herein.

DETAILED DESCRIPTION

Figure 1:
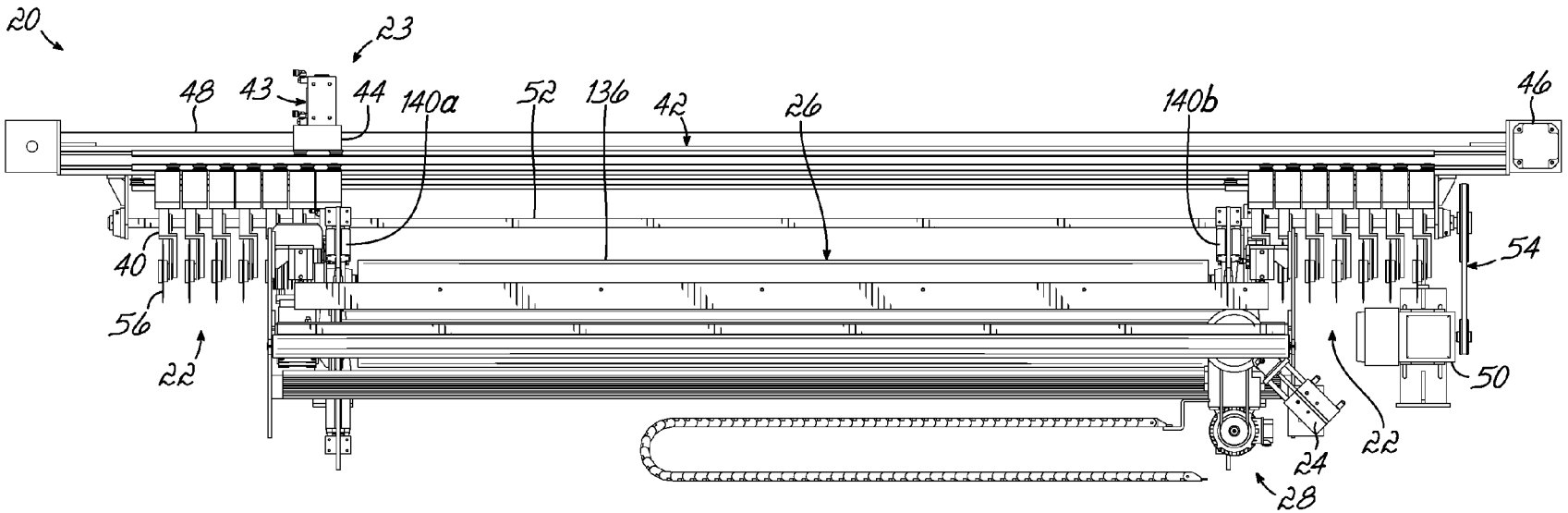
FIG. 1 is an upstream end view of a programmable border slitter.
Figure 2:
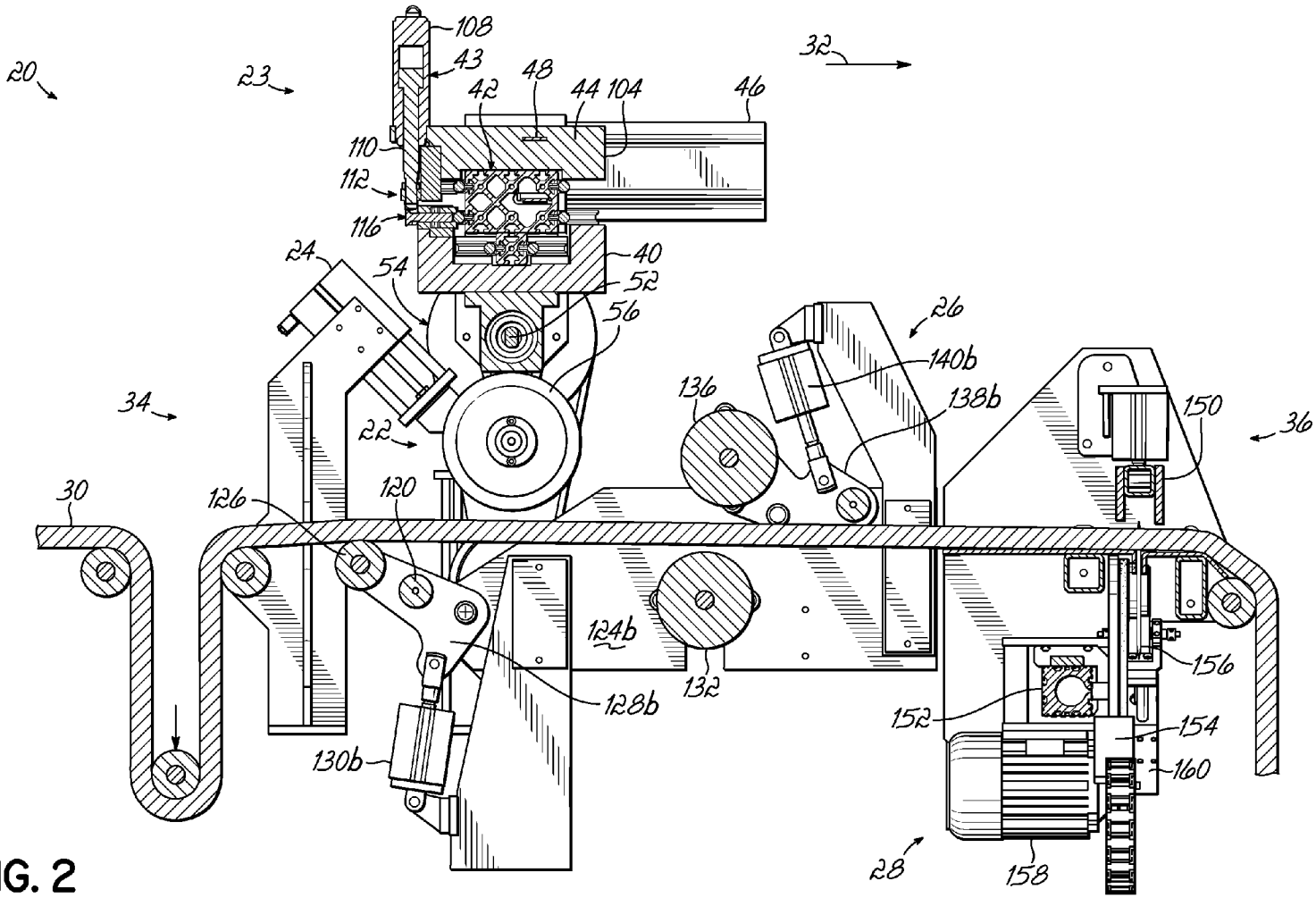
FIG. 2 is a cross-sectional side view of the programmable border slitter of FIG. 1.

Referring to FIGS. 1 and 2, an exemplary embodiment of a programmable border slitter 20 includes exemplary embodiments of a slitting system 22, a slitting blade positioning system 23, a slitting blade sharpener system 24, a material feed system 26 and a cross cutter system 28. Material 30 to be slit is fed through the programmable border slitter 20 from left to right as viewed in FIG. 2 and shown by the arrow 32. The material 30 is only a representative showing; and in practice, either single pieces or a stack of soft goods may be cut. A downstream direction means a direction the same as the direction of material flow arrow 32, and an upstream direction means a direction opposite the direction of material flow arrow 32. Further, the border slitter 20 has a front 34 into which the material 30 is fed and a back 36 from which the material 30 exits the border slitter 20. Thus, FIG. 1 is an end view of the border slitter 20 looking from the back toward the front in an upstream direction. Depending on the application, the border slitter 20 may be supported on a base or frame (not shown) in a generally horizontal orientation as shown in FIG. 2 or alternatively, in a generally vertical orientation.

Figure 3:
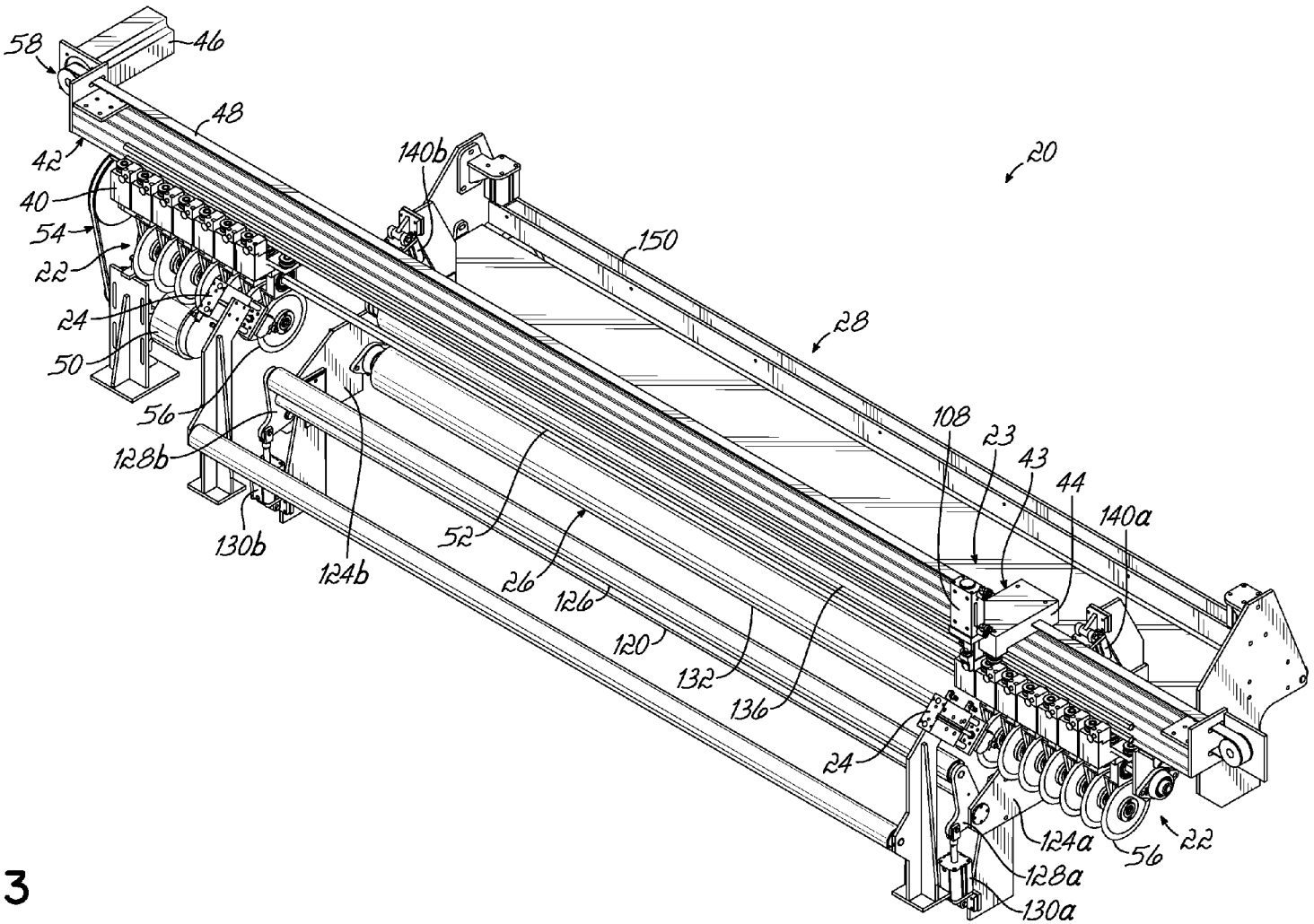
FIG. 3 is a perspective view of the front end of the programmable border slitter of FIG. 1.
Figure 4:
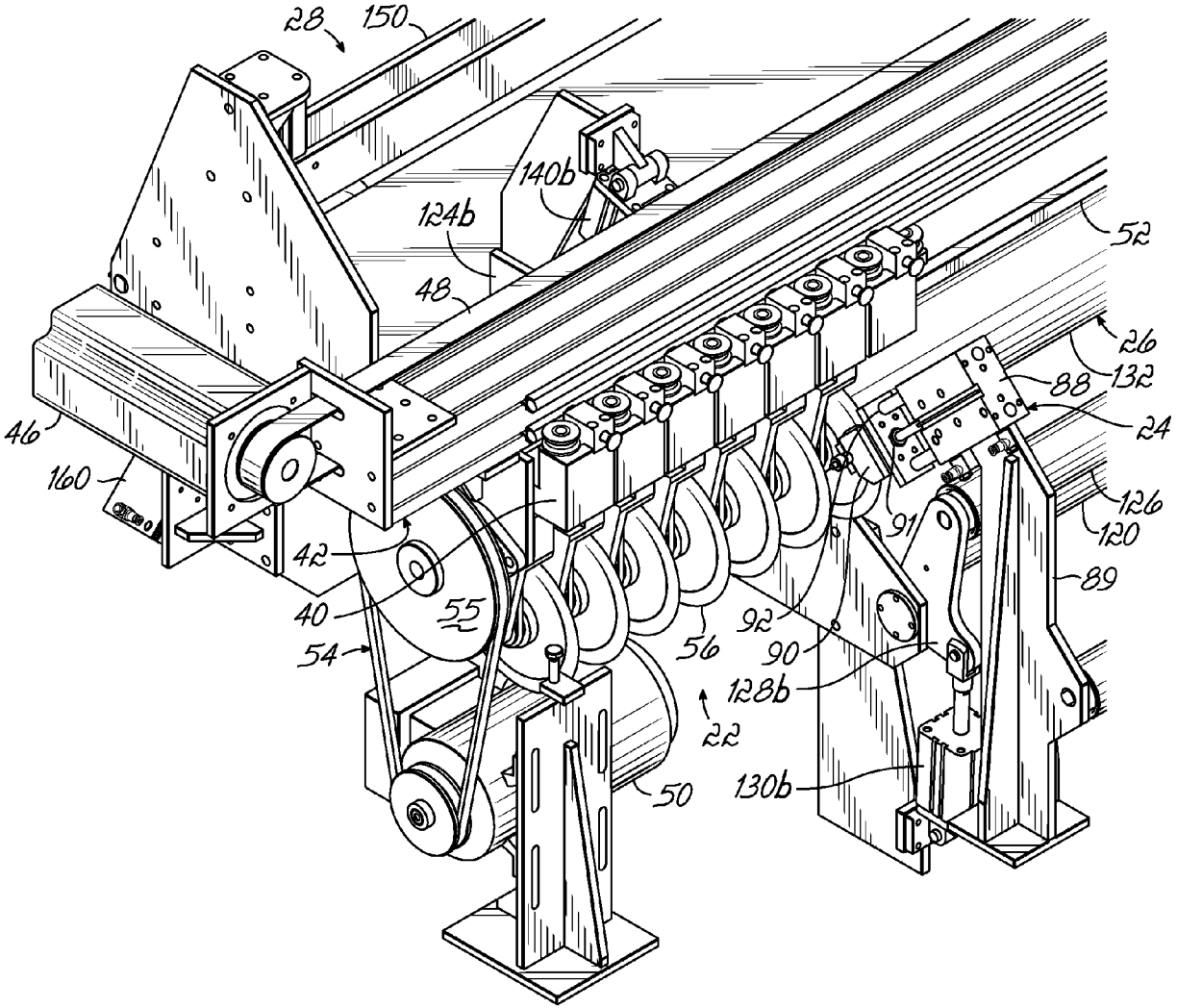
FIG. 4 is a partial perspective view of the front end of the programmable border slitter of FIG. 1.

Referring to FIG. 3, the slitting system 22 includes a plurality of slitting blade assemblies 40 that are movably mounted on a support bar assembly 42 that extends across a width of the border slitter 20. The slitting blade positioning system 23 has a slitting blade positioner 43 that includes positioning carriage 44, which is also mounted on the support bar assembly 42. The positioning carriage 44 is connectable to a drive belt 48 that is part of a belt and pulley drive 58 operated by a drive motor 46, which is operable to move the positioning carriage 44 to different positions on the support bar assembly 42. Thus, the support bar assembly 42 functions as a cross rail or track for the slitting blade assemblies 40 and the slitting blade positioning carriage 44. As shown in FIG. 4, a slitting blade drive motor 50 rotates a slitting blade drive pulley 55 and drive shaft 52 by means of a pulley and belt drive 54. In this embodiment, all of the slitting blades 56 are rotated by a common drive shaft 52.

Figure 5:
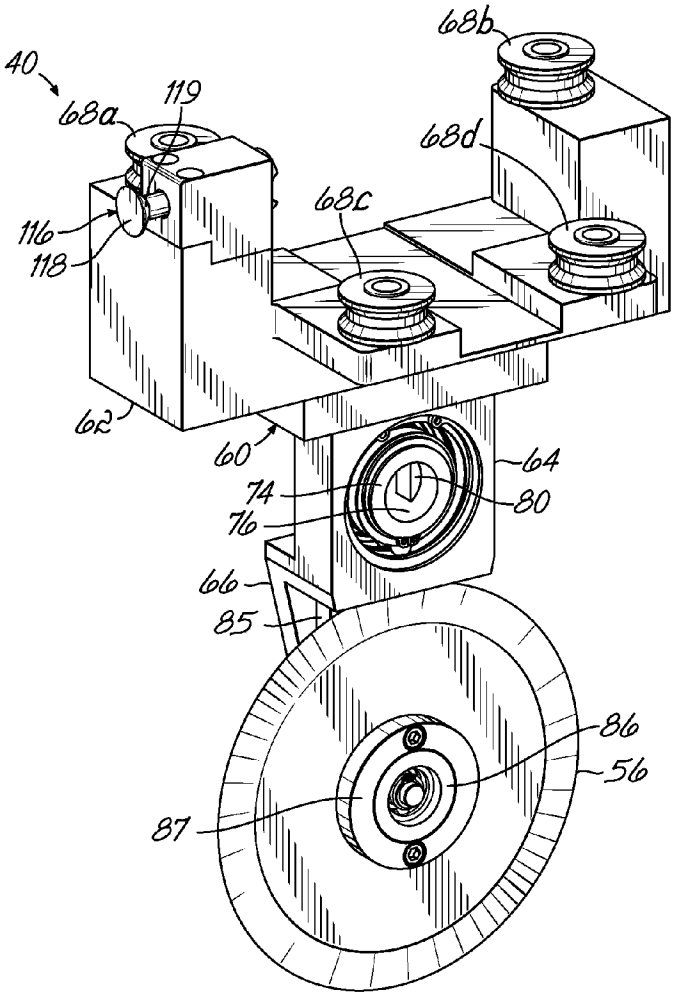
FIG. 5 is a perspective view of one side of an exemplary first slitting blade system usable with the programmable border slitter of FIG. 1.

Each of the slitting blade assemblies 40 is substantively identical; and therefore, only a single system will be shown and described in detail. Referring to FIG. 5, each slitting blade system 40 has a mounting bracket 60 that includes a guide block 62, a drive block 64 and a slitting blade mount 66. Guide rollers 68*a*-68*d* are mounted on the guide block 62, and the guide rollers 68*a*-68*d* freely rotate with respect to the slitting blade system 40.

Figure 6:
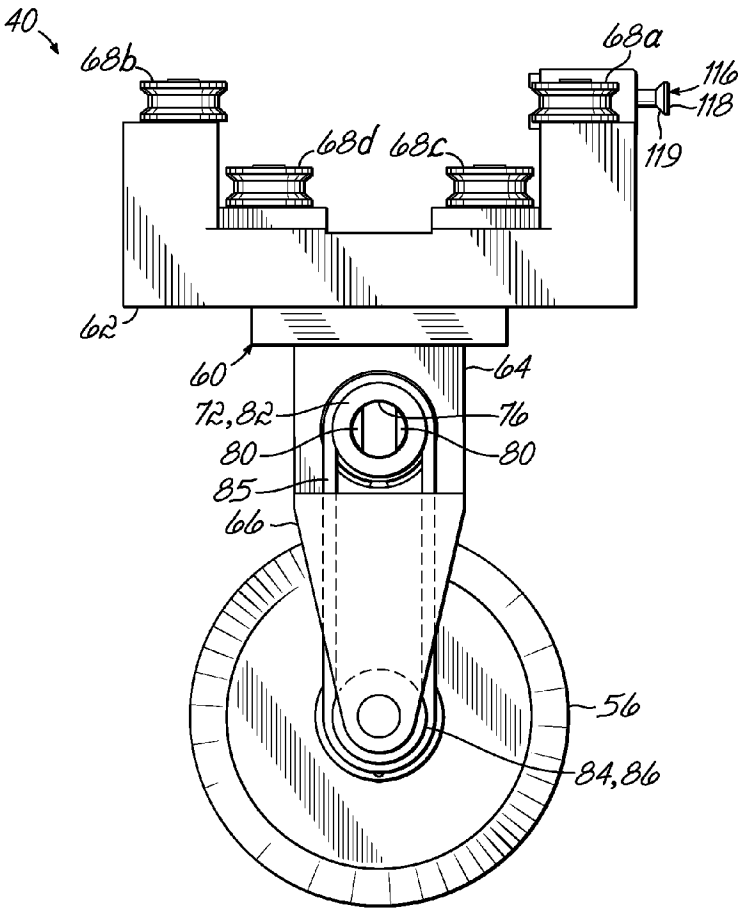
FIG. 6 is an elevation of an opposite side of the first slitting blade system.

The drive block 64 has a drive collar 74 that is mounted in bearings and thus, freely rotatable with respect to the drive block 64. The central bore 76 has opposed keys 80. The keys 80 are separated by a distance permitting the drive shaft 52 (FIG. 4) to slide therebetween. The drive shaft 52 has a non-circular cross section, for example, a square, hexagonal, octagonal or other non-circular cross section; and thus, the drive collar 74 is rotated by the drive shaft 52. Referring to FIG. 6, a drive pulley 82 is rigidly connected to one end of the drive collar 74. The drive pulley provides rotational motion to a driven pulley 84 by means of a belt 85. The driven pulley 84 is mounted on one end of a spindle 86 (FIG. 5), and the spindle 86 and driven pulley 84 are freely rotatable with respect to the slitting blade mount 66. The slitting blade 56 is mounted on an opposite end of the spindle 86 and is held in place by a nut 87 that is threaded onto the opposite end of the spindle 86. Thus, the slitting blade 56 may be easily replaced by simply removing the nut 87.

Figure 7:
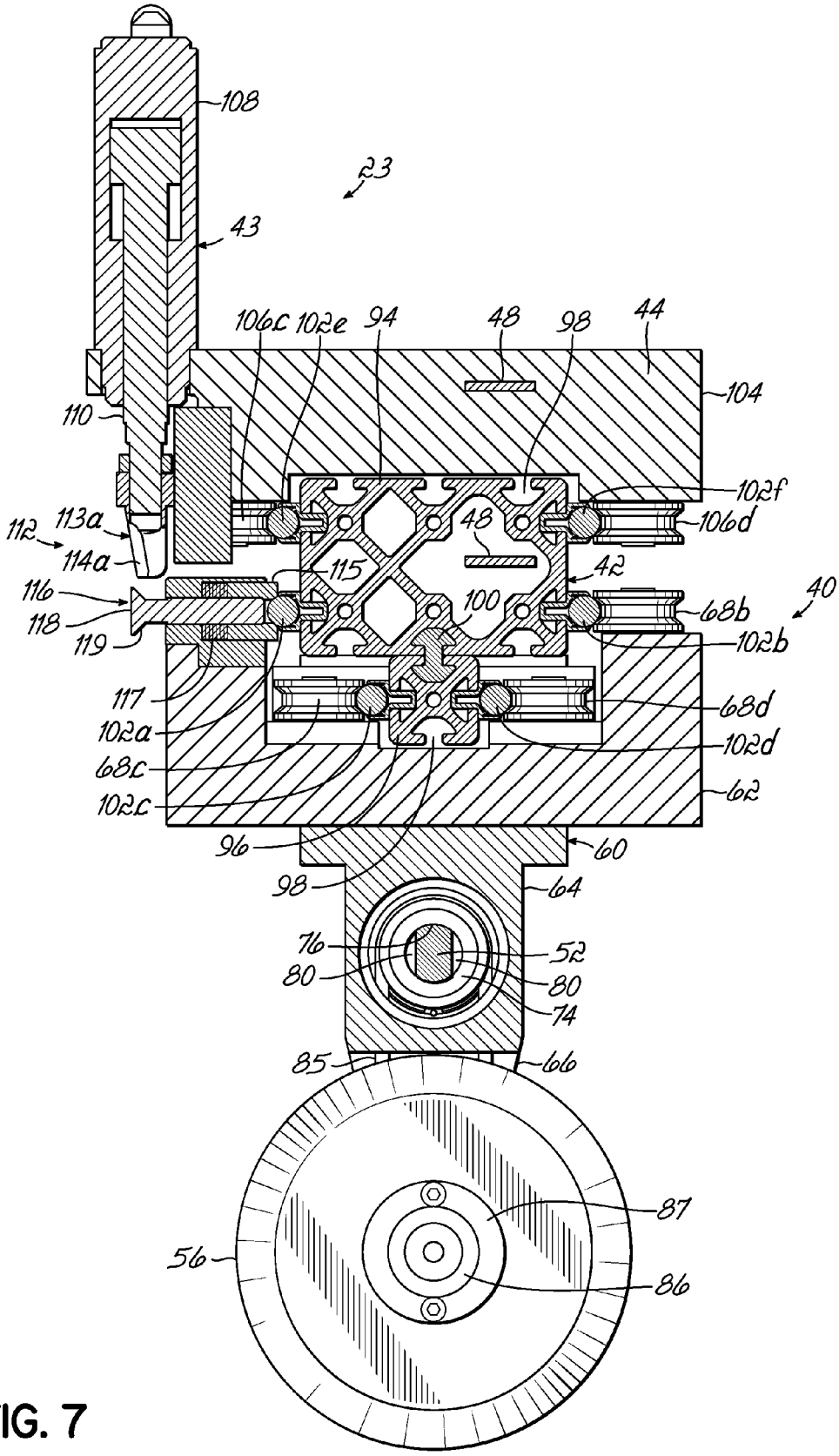
FIG. 7 is a cross-sectional view of the first slitting blade system, positioning carriage and support bar assembly of the programmable border slitter of FIG. 1.

Referring to FIG. 7, the support bar assembly 42 is made up of a large support bar 94 and a small support bar 96. The support bars 94, 96 are commercially available aluminum extrusions. The support bars 94, 96 have a plurality of lengthwise T-slots 98 located about a cross-sectional perimeter, and the support bars are connected together by fasteners, one of which is shown at 100, which are also commercially available for that purpose. A plurality of linear guide rails 102*a*-102*f* are inserted in selected T-slots 98 and held in place by a friction fit. The guide rails 102*a*-102*f* are also commercially available parts that are designed to be used with the support bars 94, 96. A slitting blade system 40 is mounted on the support bar assembly 42 by sliding the guide rollers 68*a*-68*d* over respective guide rails 102*a*-102*d*, thereby allowing the slitting blade system 40 to be easily moved lengthwise along the support bar assembly 42. As shown in FIG. 1, the support bar assembly 42 has a length that permits slitting blade assemblies 40 not being used to be stored at one or both ends of the support bar assembly 42 in idle positions. Referring to FIG. 6, guide rollers 68*a*, 68*b* have a wider separation than guide rollers 68*c*, 68*d* to minimize any tendency of the slitting blade system 40 to rock or bind when mounted on the support bar assembly as shown in FIG. 7.

Figure 8:
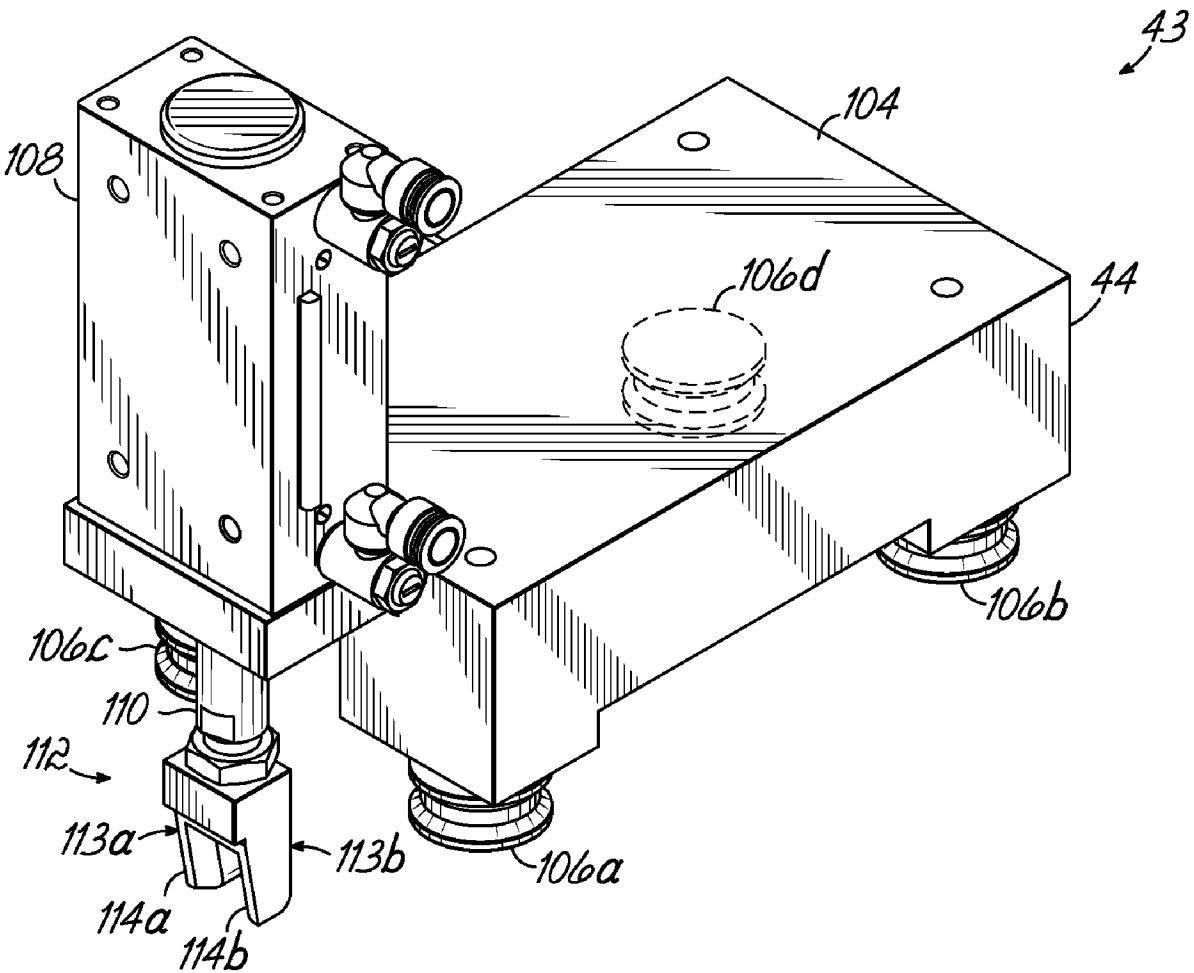
FIG. 8 is a perspective view of an exemplary embodiment of a positioning carriage usable with the programmable border slitter of FIG. 1.
Figure 9:
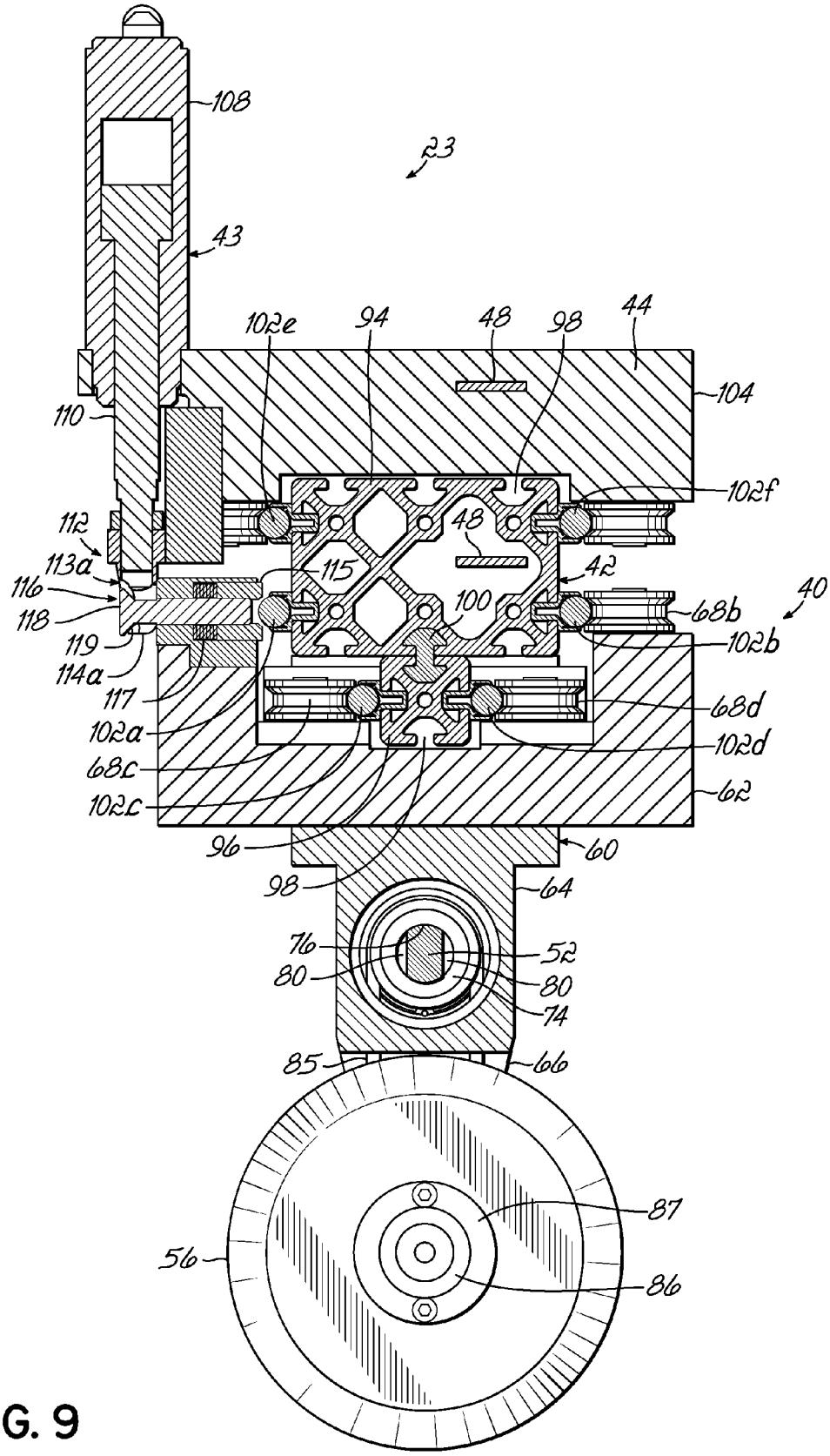
FIG. 9 is a cross-sectional view of the first slitting blade system, positioning carriage and support bar assembly of the programmable border slitter of FIG. 1.

Referring to FIG. 8, the positioning carriage 44 of the slitting blade positioner 43 has a body 104 on which are rotatably mounted four roller guides 106*a*, 106*b*, 106*c*, 106*d*. A slitting blade pickup cylinder or solenoid 108, which may be pneumatic or electric, is connected at one end of the body 104. The cylinder 108 is operable to extend and retract a cylinder rod 110. A generally U-shaped claw 112 is connected to a distal end of the cylinder rod 110. The claw 112 has opposed legs or fingers 113*a*, 113*b* with respective forward edges 114*a*, 114*b* that taper toward a distal end of the claw 112.

Referring back to FIG. 7, the positioning carriage 44 is mounted on the support bar assembly 42 by sliding the guide rollers 106*a*, 106*c* over linear guide rails 102*e* and guide rollers 106*b*, 106*d* over linear guide rail 102*f*. Thus, the positioning carriage 42 is freely movable lengthwise along the support bar assembly 42.

The slitting blade system 40 also has a locking pin 116 that is connected to a collar 115, for example, by threads, pinning or a comparable connection. A biasing device 117, for example, a compression spring, one or more Belleville washers or comparable biasing device, is used to create a biasing force against the collar 115 toward the guide rail 102*a*. Thus, the biasing means 117 causes the collar 115 and pin 116 to apply a locking force against guide rail 102*a*, thereby preventing the slitting blade system 40 from moving with respect to the support bar assembly 42. Upon actuating the slitting blade pickup cylinder 108, the cylinder rod 110 and fingers 113*a*, 113*b* extend toward the locking pin 116. The tapered forward edges 114*a*, 114*b* of the respective fingers 113*a*, 113*b* contact the angled surface 119 of the locking pin 116; and upon the cylinder rod 110 and fingers 113*a*, 113*b* being fully extended, the claw 112 moves the collar 115 and locking pin 116 to the left as viewed in FIG. 7. Thus, as shown in FIG. 8, the fingers 113*a*, 113*b* lift the collar 115 and locking pin 116 from contact with the guide rail 102*a*. Upon actuation of the positioning motor 46 (FIG. 3), the positioning carriage 44 and slitting blade system 40 are movable lengthwise along the support bar assembly 42. When the positioning carriage 44 has moved the slitting blade system 40 to a desired position, the state of the slitting blade pickup cylinder 108 is switched; and the cylinder rod 110 and fingers 113*a*, 113*b* are retracted to the positions shown in FIG. 7. The biasing means 117 moves the collar 115 and locking pin 116 to the right as viewed in FIG. 7 and into contact with the guide rail 102*a*, thereby preventing the slitting blade system 40 from moving with respect to the guide rail 102*a*.

As shown in FIG. 3, a blade sharpener system 24 is located at each end of the width of the border slitter 20 adjacent the slitting blades 56. Each sharpener system 24 is substantially similar in construction and operation; and therefore, only one will be described in detail. Referring to FIG. 4, a sharpener cylinder or solenoid 88, which may be pneumatic or electric, is supported on a bracket 89. A slitting blade sharpener 90 is attached to respective distal ends of a cylinder rod 91 and a pair of guide rods 92. In one state, the cylinder 88 retracts the cylinder rod 91, guides rods 92 and sharpener 90, which removes the sharpener 90 from contact with a juxtaposed slitting blade 56. When the state of the cylinder 88 is switched, the cylinder rod 91, guide rods 92 and sharpen 90 are extended to move the sharpener 90 into contact with the juxtaposed slitting blade 56 and sharpening it.

Figure 10:
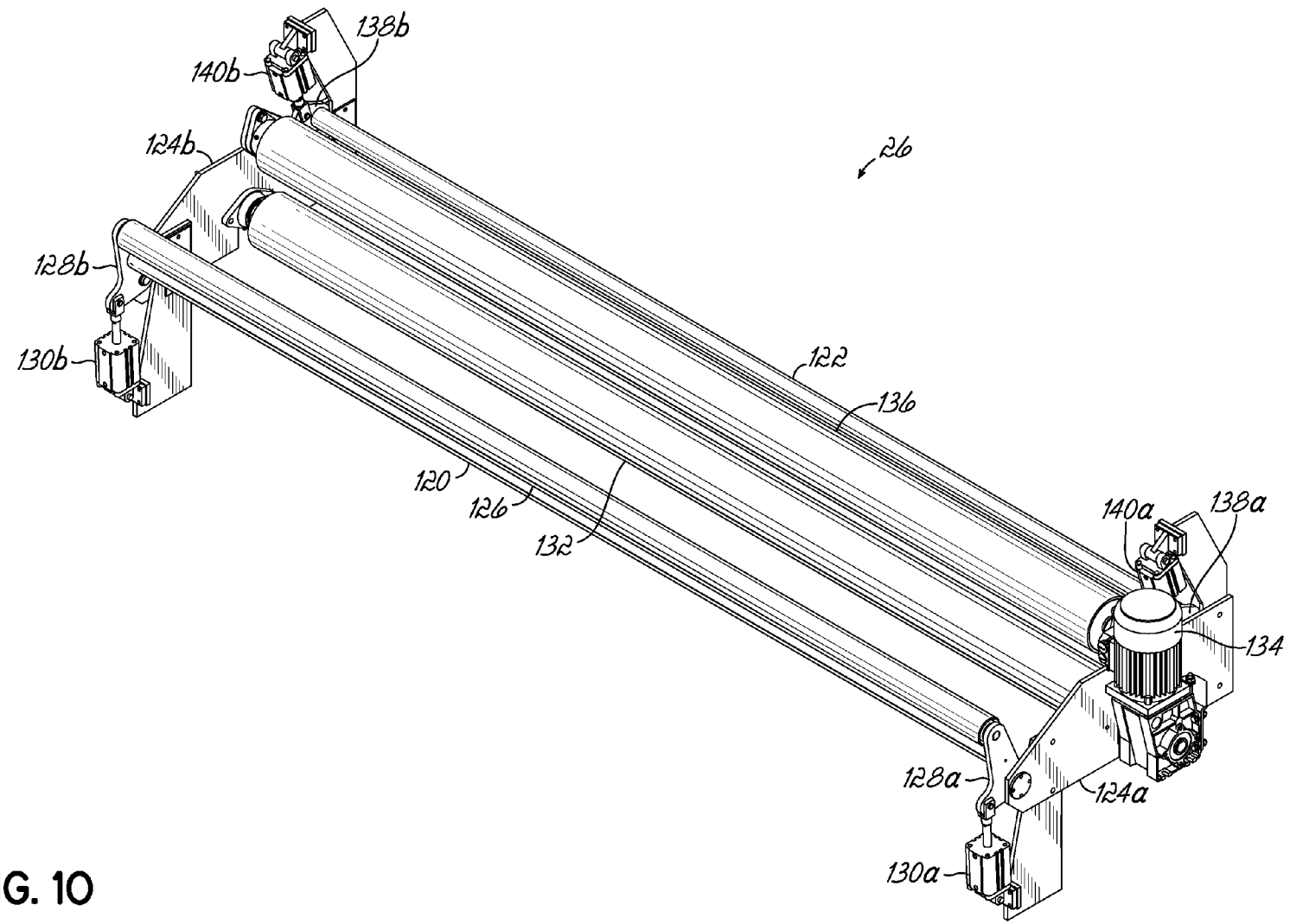
FIG. 10 is a perspective view of an exemplary embodiment of a material feed used with programmable border slitter of FIG. 1.
Figure 11:
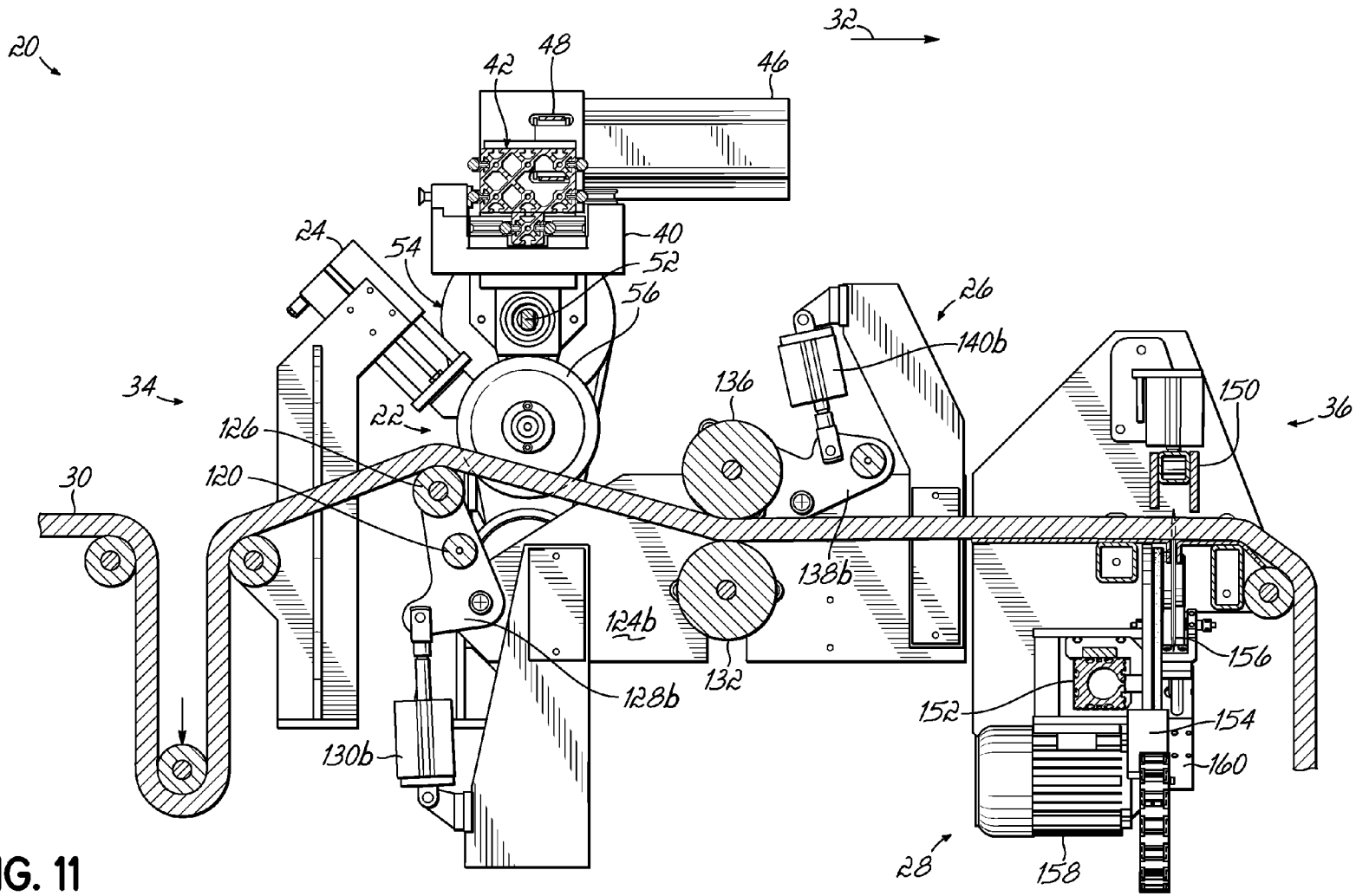
FIG. 11 is a cross-sectional side view of the programmable border slitter of FIG. 1.

The material feed system 26 is shown in more detail in FIG. 10. The system has two idler rollers 120, 122 that are mounted to be freely rotatable with respect to the idler frame members 124*a*, 124*b*. A slitting engagement roller 126 is rotatably mounted at its ends to respective ends of angle brackets 128*a*, 128*b* that, in turn, are pivotally mounted to respective frame members 124*a*, 124*b*. Slitting blade engagement cylinders or solenoids 130*a*, 130*b*, which may be pneumatic or electric, are also supported by respective frame members 124*a*, 124*b* and are pivotally connected to opposite ends of the respective engagement brackets 128*a*, 128*b*. As shown in FIG. 2, when the cylinders 130*a*, 130*b* are in a first state, the slitter engagement roller 126 supports the material 30 at a position removed from a slitting blade 56. However, as shown in FIG. 11, when the cylinders 130*a*, 130*b* switch states, the slitter engagement roller 126 is pivoted toward the slitting blade 56; and the material 30 is moved to a position engaging the slitting blade 56.

Referring again to FIG. 10, a feed or puller roller 132 is rotated by a material feed motor 134. A pinch roller 136 is rotatably mounted at its ends to respective ends of angle brackets 138*a*, 138*b* that, in turn, are pivotally mounted to respective frame members 124*a*, 124*b*. Pinch roller cylinders or solenoids 140*a*, 140*b*, which may be pneumatic or electric, are also supported by respective frame members 124*a*, 124*b* and are pivotally connected to opposite ends of the respective engagement brackets 138*a*, 138*b*. As shown in FIG. 2, when the pinch roller cylinders 140*a*, 140*b* are in a first state, the pinch roller 136 supports the material 30 at a position removed from puller roller 132; and the material 30 is not pulled through the border slitter 20. However, as shown in FIG. 10, when the pinch roller cylinders 140*a*, 140*b* switch states, the pinch roller 126 is pivoted toward and contacts the material 30 supported by the feed or puller roller 132; and the material 30 is pulled through the border slitter 20.

Figure 12:
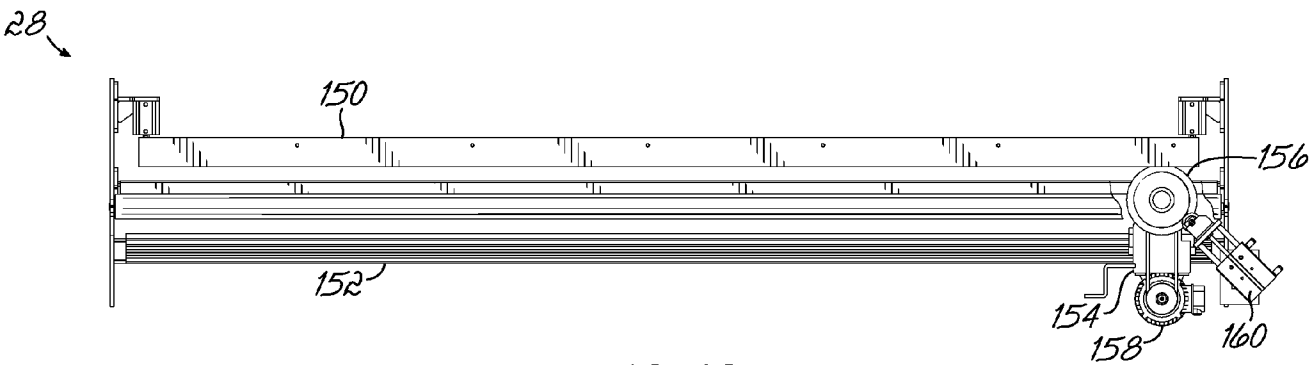
FIG. 12 is an end view of a cross cutter system.

Referring to FIG. 12, the cross cutter system 28 has a frame 150 that extends across a width of the border slitter 20. The frame 150 supports a linear guide rail 152 on which is mounted a cross cutter carriage 154 that, in turn, supports a cross cutter blade 156, a cross cutter motor 158 and a blade sharpener 160. The cross cutter system 28 is operable in a known manner to move the cross cutter blade 156 along the length of the guide rail 152, thereby cutting the material to a desired length. The cross cutter sharpener 160 is substantially similar in construction and operation to the sharpener system 24 described with respect to FIG. 4.

Figure 13:
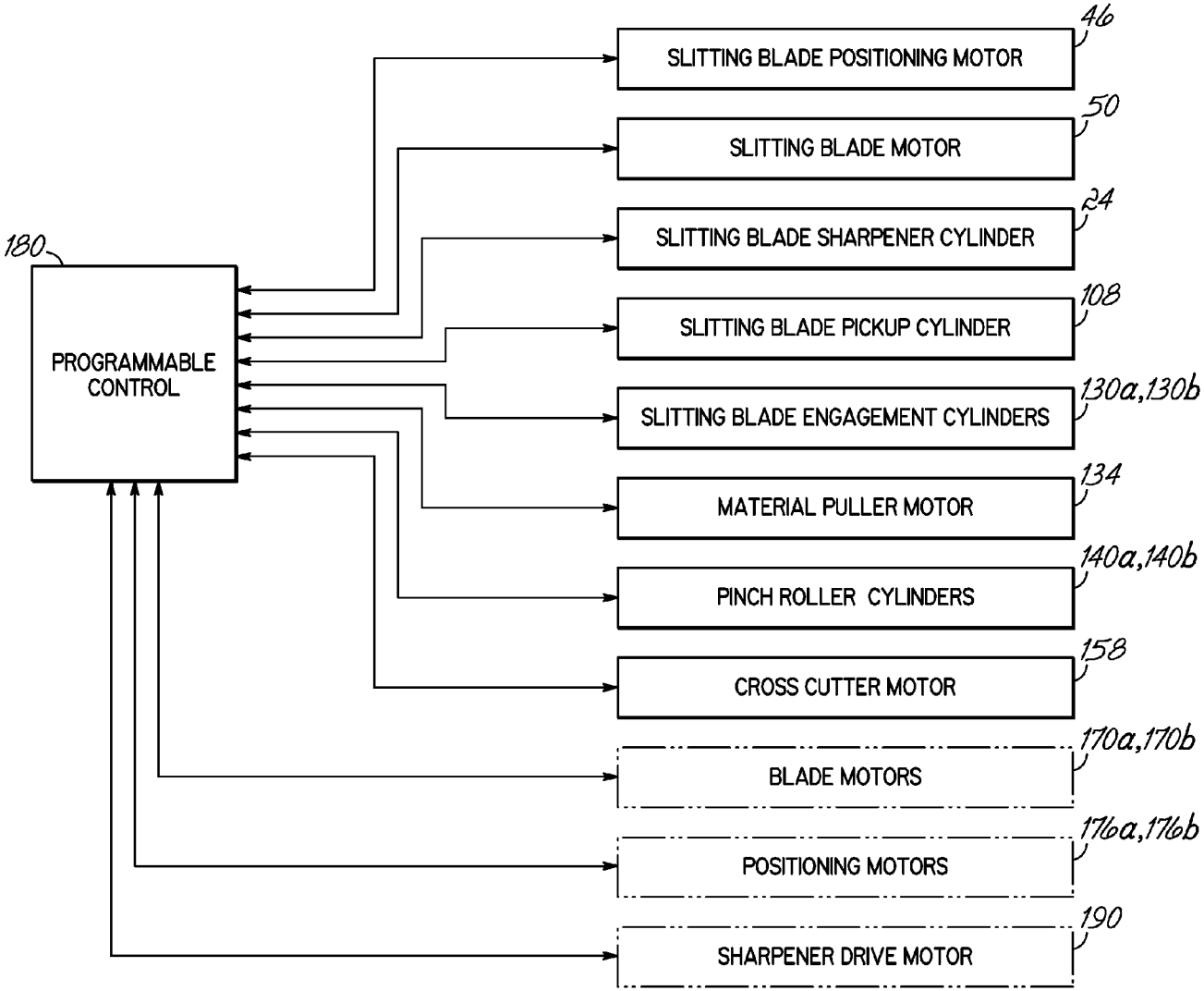
FIG. 13 is a schematic block diagram of a control circuit of the programmable border slitter of FIG. 1.
Figure 14:
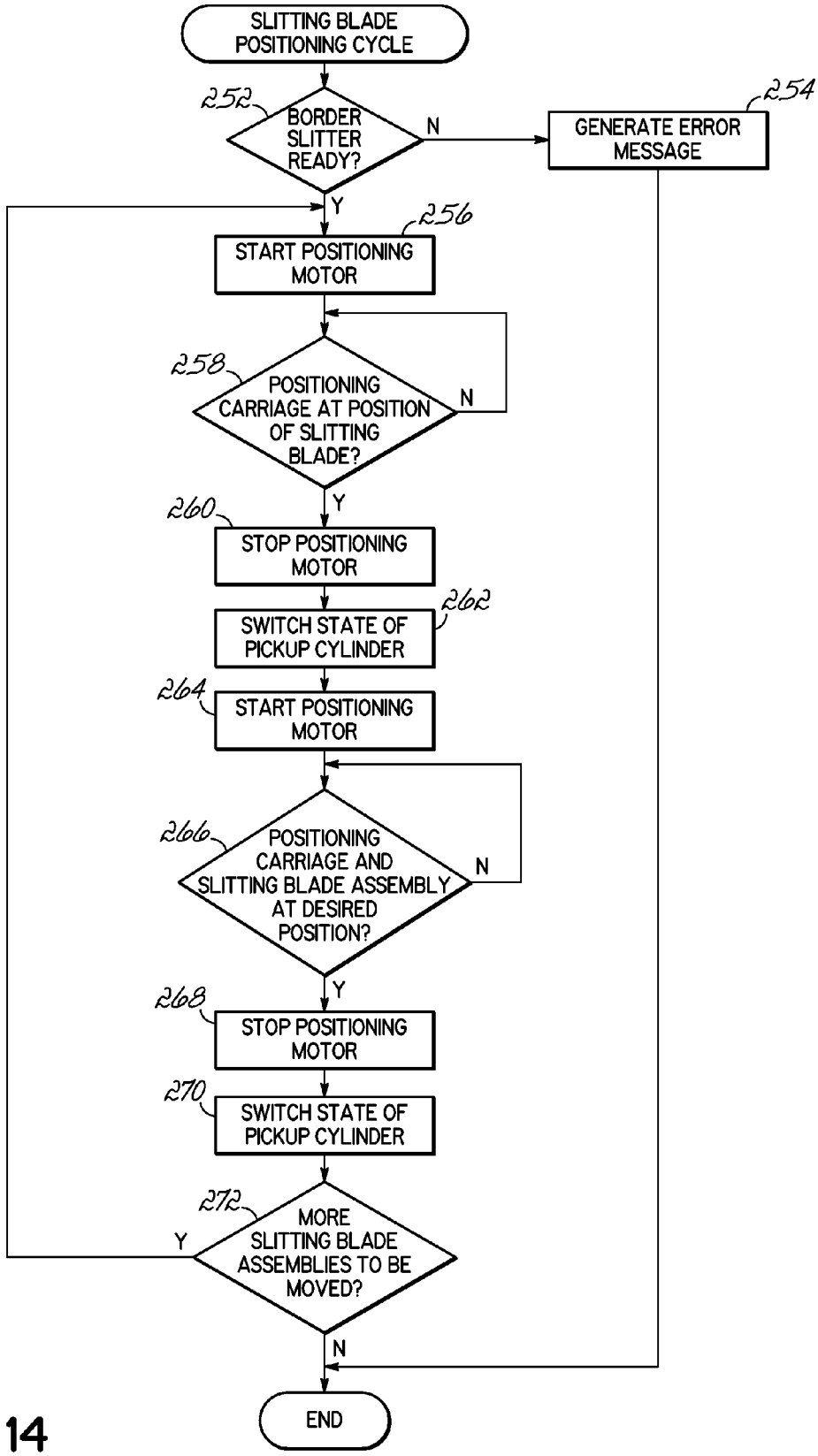
FIG. 14 is a flow chart schematically illustrating a slitting blade positioning process executable by the programmable border slitter of FIG. 1.

Referring to FIG. 13, a programmable control 180 is used to coordinate the operation of the various motors and cylinders on the programmable border slitter 20. For a particular set of border pieces to be slit, the programmable control 180 contains data relating to the widths of those border pieces; and it operable to move slitting blade assemblies 40 to desired positions on the support bar assembly 42 such that the desired widths of the border pieces will be slit. An exemplary slitting blade positioning cycle is schematically illustrated in FIG. 14. First, at 252, the control 180 determines whether the border slitter is ready to have slitting blade assemblies moved across the support bar assembly 42. For example, the border slitter 20 should have a state as shown in FIG. 2, wherein the slitter engagement roller 126 is retracted from the slitter blades 56. If those conditions or other conditions are not met, the control 180 generates an error message as indicated at 254.

If proper conditions do exist, the control 180, commands, at 256, the positioning motor 46 to move the positioning carriage 44 along the support bar assembly 42 toward a slitting blade system 40 to be picked up. The position of the carriage 44 is detectable by the control 180 using known motor control technologies. Upon the control 180 determining, at 258, that positioning carriage 44 is immediately adjacent a desired slitting blade system, the control 180 then, at 260, stops the positioning motor 46. Thereafter, the control 180 switches, at 262, the state of the pick up cylinder 108. That operation moves the claw 112 below the head of the locking pin 116 and releases the desired slitting blade system for motion along the support bar assembly 42.

Thereafter, the control 180 again, at 264, starts the positioning motor 46 which is effective to move the positioning carriage 44 and the desired slitting blade system 40 along the support bar assembly 42 toward a desired position. When the control 180 detects, at 266, that the desired position is reached, it commands, at 268, the positioning motor 46 to stop. Thereafter, the control 180 commands, at 270, the pick up cylinder 108 to switch states. That operation retracts the claw 116 from beneath the locking pin head 118, thereby permitting the biasing means 117 to move the collar 115 and locking pin 116 against the guide rail 102*a*, thereby inhibiting motion of the desired slitting blade system with respect to the guide rail 102*a*. The control 180 then, at 272, determines whether more slitting blade assemblies are to be moved to desired respective positions along the support bar assembly 42. If so, the process described at steps 258-272 is repeated until all of the slitting blade assemblies are in position.

Figure 15:
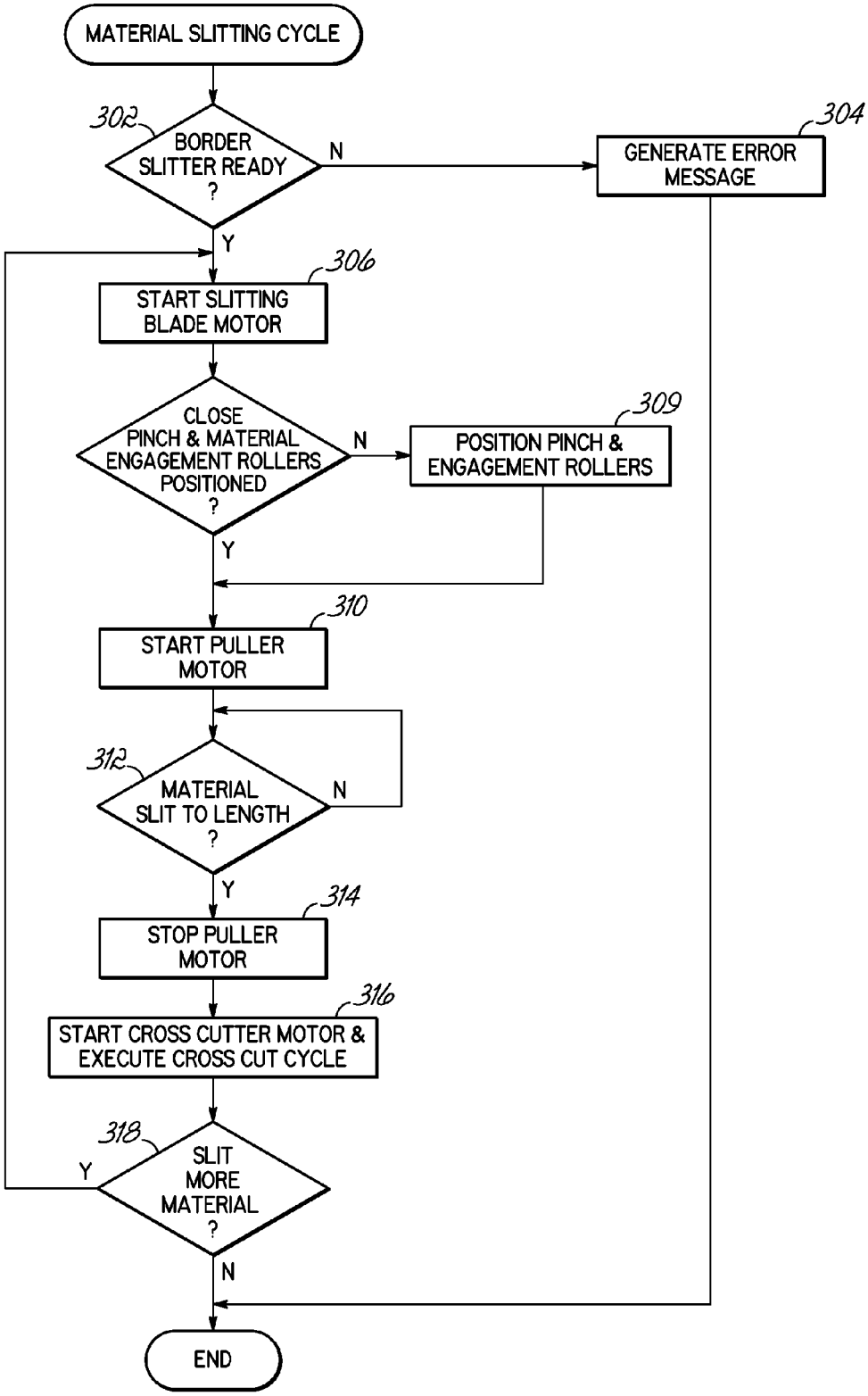
FIG. 15 is a flow chart schematically illustrating a material slitting process executable by the programmable border slitter of FIG. 1.

Thereafter, referring to FIG. 15, the control 180 is operative to execute a material slitting cycle. In doing so, the control 180 determines, at 302, whether the border slitter is ready. For example, to be ready, slitting blades must be located in their desired positions; and the material must be loaded. Other conditions may also have to be met. If the border slitter is not ready, an error message is generated at 304. If so, the control 180 commands, at 306, the slitting blade motor 50 to start. In addition, the control determines, at 308, whether the pinch and engagement rollers are in position for slitting the material. If not, the control 180, commands, at 309, the slitter engagement cylinders 130*a*, 130*b* and the pinch roller cylinders 140*a*, 140*b* to change states. This action causes the material engagement roller 126 to move the material 30 into engagement with the slitting blades 56 and the pinch roller 136 to move against the material 30 on the puller roller 132. With these actions, the border slitter 20 is in the state shown in FIG. 11. The control 180 further commands, at 310, the material feed motor 134 to start. The feed motor 134 pulls the material 30 past the slitting blades 56, thereby slitting the material 30 into border pieces of desired widths. Thereafter, the control determines, at 312, when a desired length of material has been slit. When the length is achieved, the control 180, at 314, stops the material feed motor 134 and, at 316, starts the cross cutter motor and executes a cross cut cycle, thereby cutting the slit border pieces to a desired length. The control 180 then determines, at 318, whether more of the material 30 is to be slit; and if so, the process described with respect to steps 306-318 is repeated.

At any time determined by an operator or timers or cycle counters in the control 180, the control 180 may execute a blade sharpening cycle by first, operating the positioning motor 46 (FIG. 3) to use the positioning carriage 44 to move a desired slitting blade assembly 40 adjacent the sharpener 24. Next, if the drive motor 50 is not running, the control 180 starts the drive motor 50 and switches the state of the sharpener cylinder 88. The sharpener 90 is moved into contact with a respective rotating slitting blade 56 to sharpen the blade. After a period of time that may be determined by a timer in the control 180, the control 180 again switches the state of the sharpener cylinder 88; and the sharpener 90 is retracted from the slitting blade.

The programmable border slitter 20 has the advantages automatically positioning and sharpening the slitting blades 56 and further, automatically slitting the material 30 into border pieces of desired lengths. Further, the programmable border slitter 20 automatically tracks the material 30 during the production process. In addition, the slitting blades 56 are individually mounted and thus, replaceable without having to remove other slitting blades. Thus, the programmable border slitter 20 may be operated continuously, is very efficient and border pieces can be manufactured in substantially less time than with prior methods requiring manual operations.

The programmable border slitter 20 may be incorporated in a production process that uses quilting machines to provide a quilted material prior to slitting, for example, systems that are shown and described in U.S. Pat. Nos. 5,544,599 and 6,105,520, the entireties of which are hereby incorporated herein by reference. Thus, the programmable border slitter 20 may be situated either in a separate cutting line or in-line with, and downstream of, a quilting machine.

Figure 16:
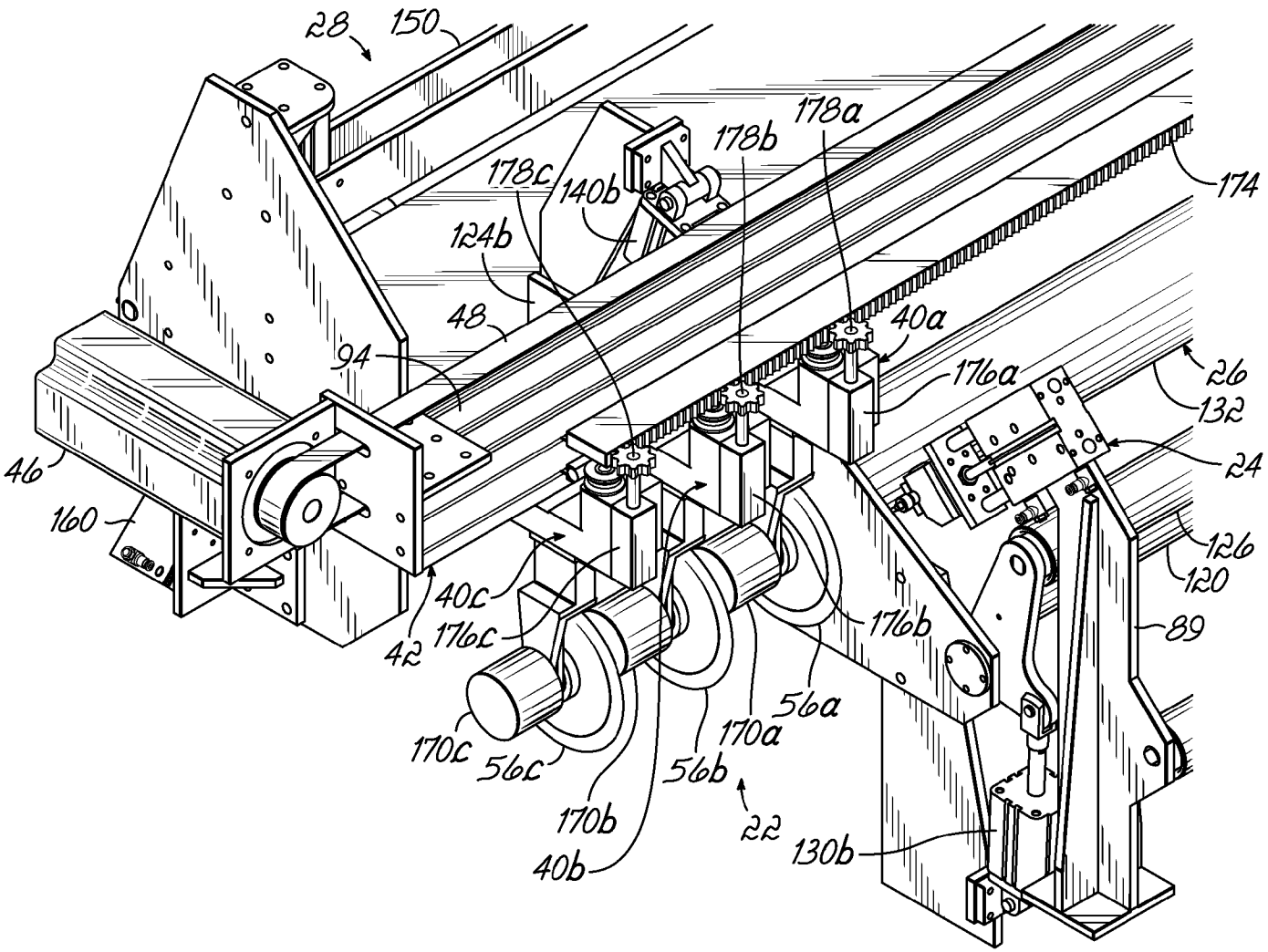
FIG. 16 is a partial perspective view of the front end of a programmable border slitter and illustrates alternative embodiments of a slitting system positioning system and slitting blade drive motors.

While the invention has been illustrated by the description of exemplary embodiments and while the exemplary embodiments have been described in considerable detail, there is no intention to restrict nor in any way limit the scope of the appended claims to such detail. Additional advantages and modifications will readily appear to those who are skilled in the art. For example, in the exemplary embodiment of FIG. 4, the slitting blades 56 are rotated by a slitting blade motor via a common shaft 52 that, in turn, is rotated by a belt drive 54. In alternative embodiments, the belt drive 54 may be replaced by a gear drive or clutch drive, for example, a mechanical, magnetic or fluid clutch. In further alternative embodiments, as shown in FIG. 16, each of the slitting blades, for example, slitting blades 56*a*, 56*b*, may be individually and directly rotated by respective slitting blade motors 170*a*, 170*b*. The slitting blade motors 170*a*, 170*b* are connected to, and controlled by, the control 180 as shown in phantom in FIG. 13.

In the exemplary embodiment of FIG. 3, a slitting blade positioning system 23 independent of the slitting blade assemblies 40 is operable to move each of the slitting blade assemblies 40 to desired positions along the length of the support bar assembly 42. Referring to FIG. 16, in an alternative embodiment, each of the slitting blade assemblies 40 may be individually moved along the support bar assembly 42 by respective slitting blade positioning systems. In this exemplary embodiment, a toothed rack 174 is mounted on support bar 94. Each of the slitting blade assemblies, for example, assemblies 40*a*, 40*b*, has a respective positioning motor, for example, positioning motors 176*a*, 176*b* that, in turn, rotate respective pinion gears 178*a*, 178*b*. The positioning motors 176*a*, 176*b* are connected to, and operated by, the control 180 as shown in phantom in FIG. 13. In this embodiment, multiple slitting blade assemblies 40 may be commanded by the control 180 to move individually and generally simultaneously along the support bar assembly 42.

Figure 17:
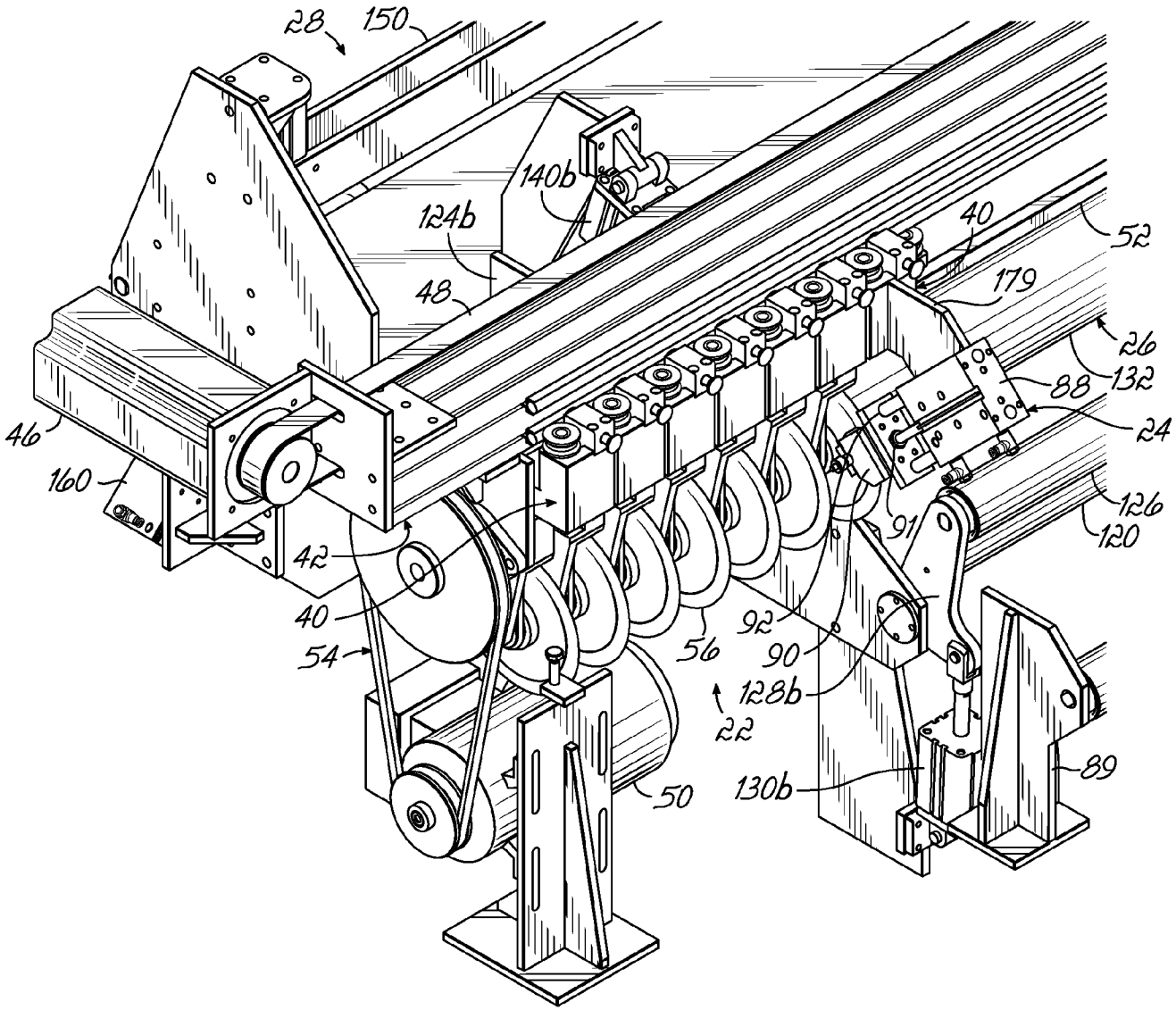
FIG. 17 is a partial perspective view of the front end of a programmable border slitter and illustrates a first alternative embodiment of a slitting blade sharpen system.
Figure 18:
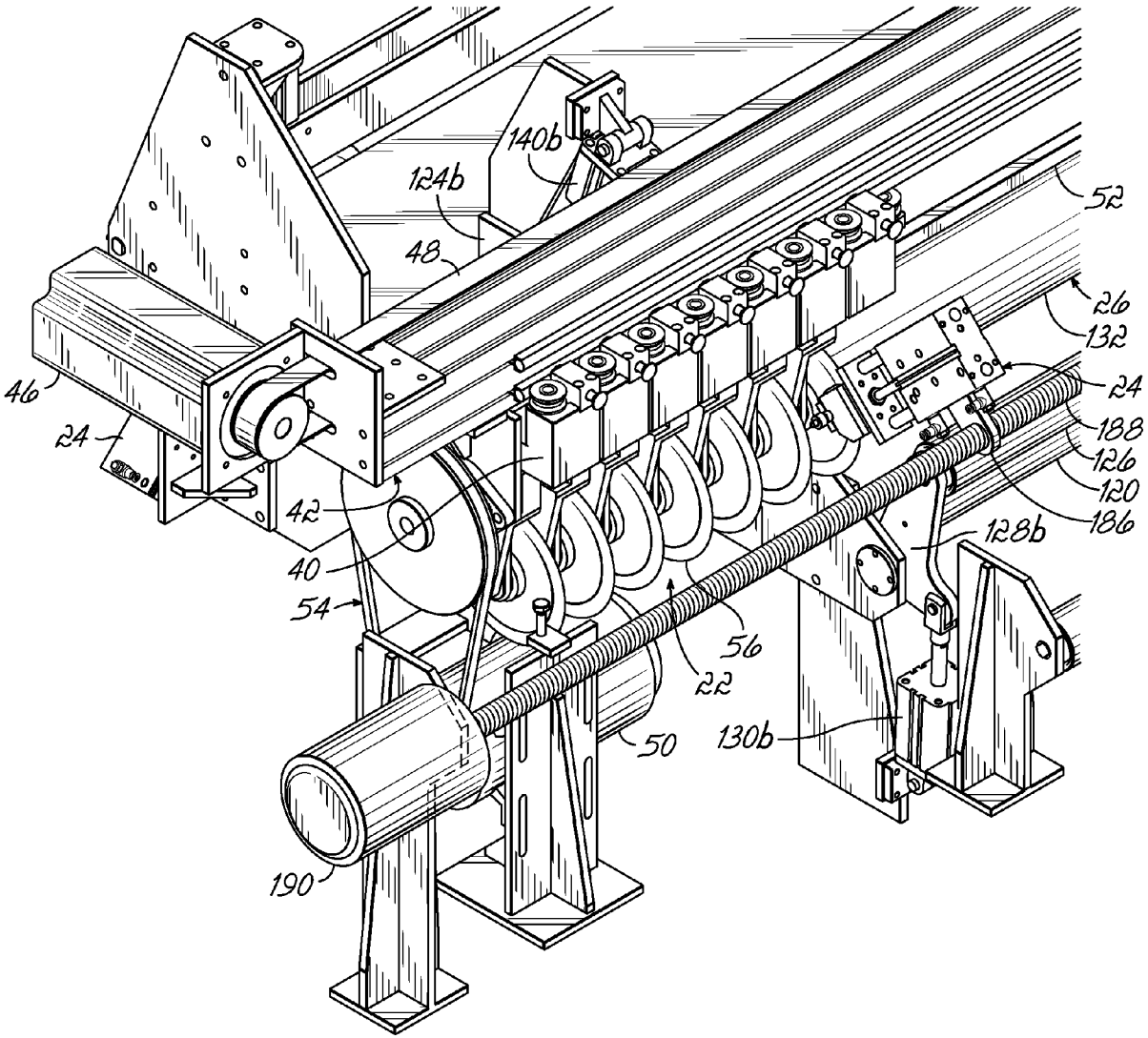
FIG. 18 is a partial perspective view of the front end of a programmable border slitter and illustrates a second alternative embodiment of a slitting blade sharpen system.

In the exemplary embodiment of FIG. 3, the sharpener assembly 24 is fixed to a bracket 89; and the slitting blades 56 are moved to the location of the sharpener 90. As shown in FIG. 17, in an alternative embodiment, a bracket 179 may be used to connect a sharpener 24 directly to a slitting blade assembly 40, so that the sharpener 24 moves with the slitting blade assembly 40. In this embodiment, each of the slitting blade assemblies 40 may be equipped with a respective sharpener 24, which is operable at any time by the control 180 to sharpen a respective slitting blade 56. In a further alternative embodiment shown in FIG. 18, the sharpener 24 may be connected to a threaded nut 186 that is mounted on a drive screw 188. The drive screw 188 is connected at one end to a sharpener drive motor 190 that, in turn, is connected to the control 180 as shown in phantom in FIG. 13. In this embodiment, the control 180 commands operation of the drive motor 190 to move the sharpener 24 adjacent a desired slitting blade 56 to be sharpened.

Figure 19:
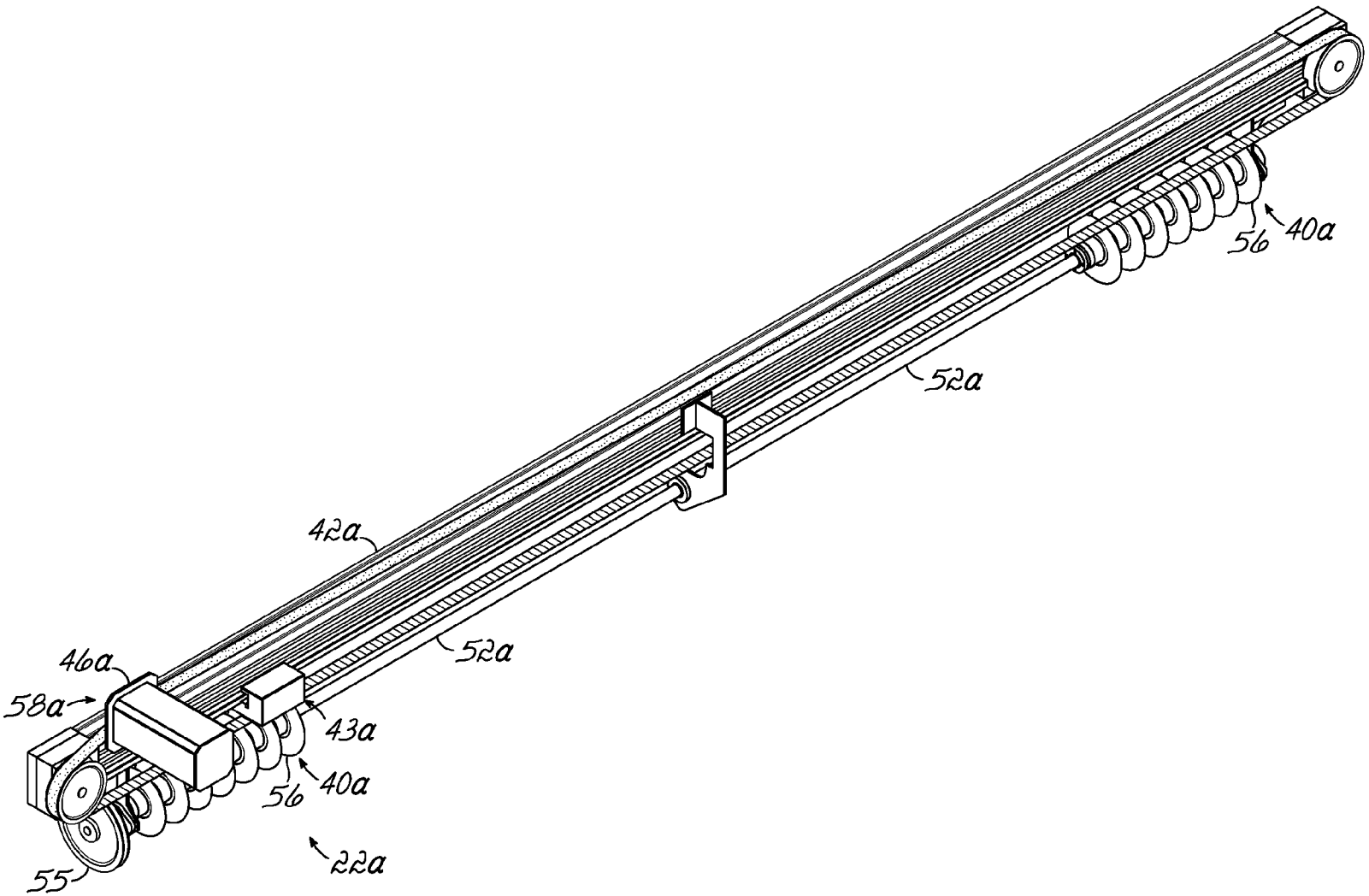
FIG. 19 is a perspective view of an exemplary alternative embodiment of a second slitting system usable with a programmable border slitter similar to that shown in FIG. 1.

The first exemplary embodiment of a slitting system 22 with a slitting blade positioning system 23 mounted on a support bar assembly 42 is shown and described in FIGS. 1-8. In that embodiment, a slitting blade positioner 43 is moved along the support bar assembly 42 by a pulley and belt drive 54. The slitting blade positioner 43 is operative to engage a particular slitting blade assembly and move it to a desired position along a slitting blade drive shaft 52. Referring to FIG. 19, in an exemplary alternative embodiment, a second slitting blade system 22*a* includes a slitting blade positioner 43*a* that is slideably mounted on a support bar assembly 42*a*. The slitting blade positioner 43*a* is connected to a pulley and belt drive 58*a* that is driven by a positioning motor 46*a* in a manner similar to that previously described. An exemplary alternative embodiment of slitting blade assemblies 40*a* are mounted on a slitting blade drive shaft 52*a* and are movable to different positions longitudinally on the drive shaft 52*a* by the slitting blade positioner 43*a*.

Figure 20:
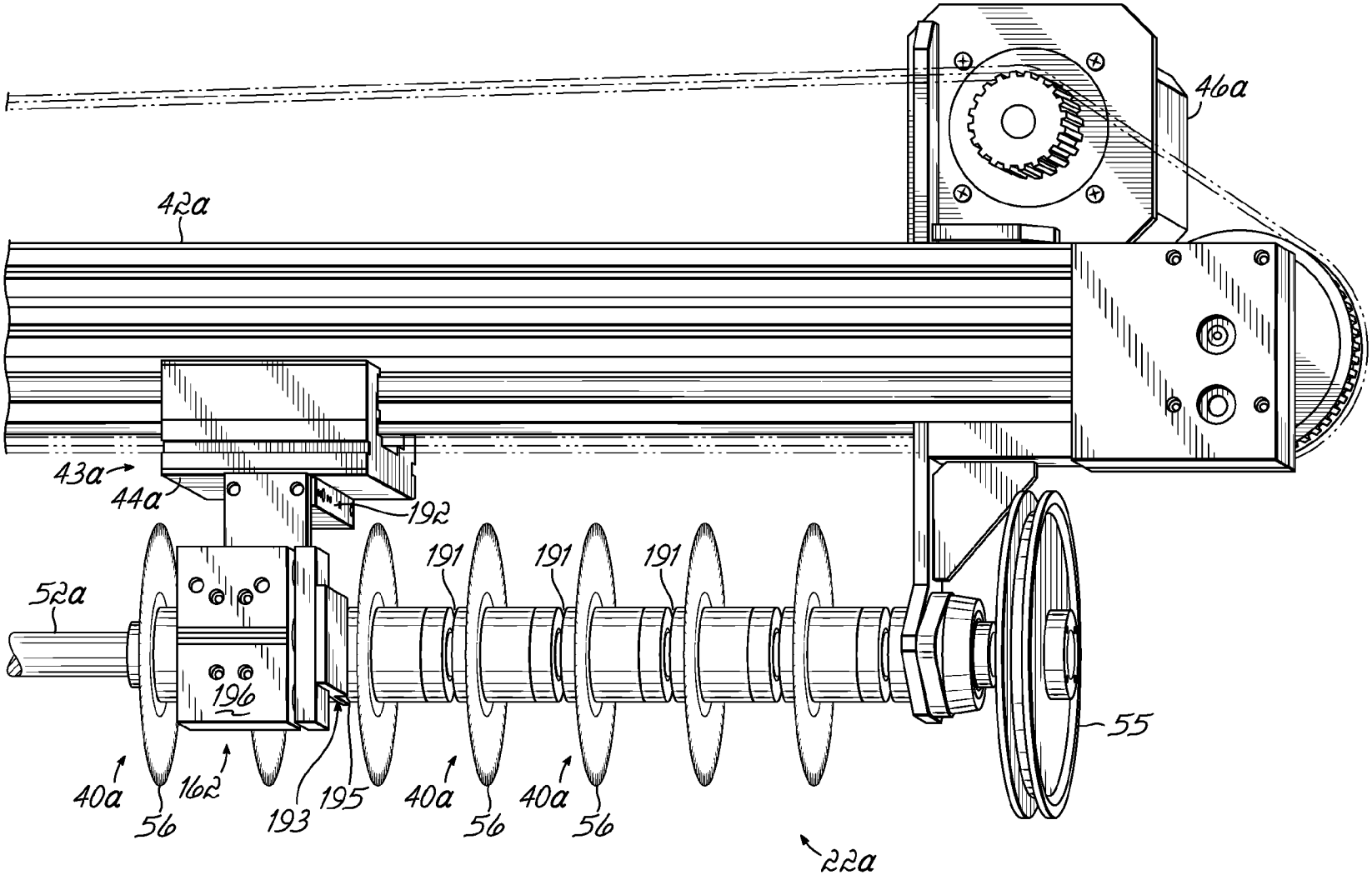
FIG. 20 is a perspective view of one end of the second slitting system shown in FIG. 19.

Referring to FIG. 20, the slitting blade positioner 43*a* includes a carriage 44*a* slideably mounted on the support bar assembly 42*a*. The carriage 44*a* supports a gripper 162 that is effective to engage each of the slitting blade assemblies 40*a* for movement along the drive shaft 52*a*. The slitting blade drive shaft 52*a* may have a circular or non-circular cross section.

Figure 22:
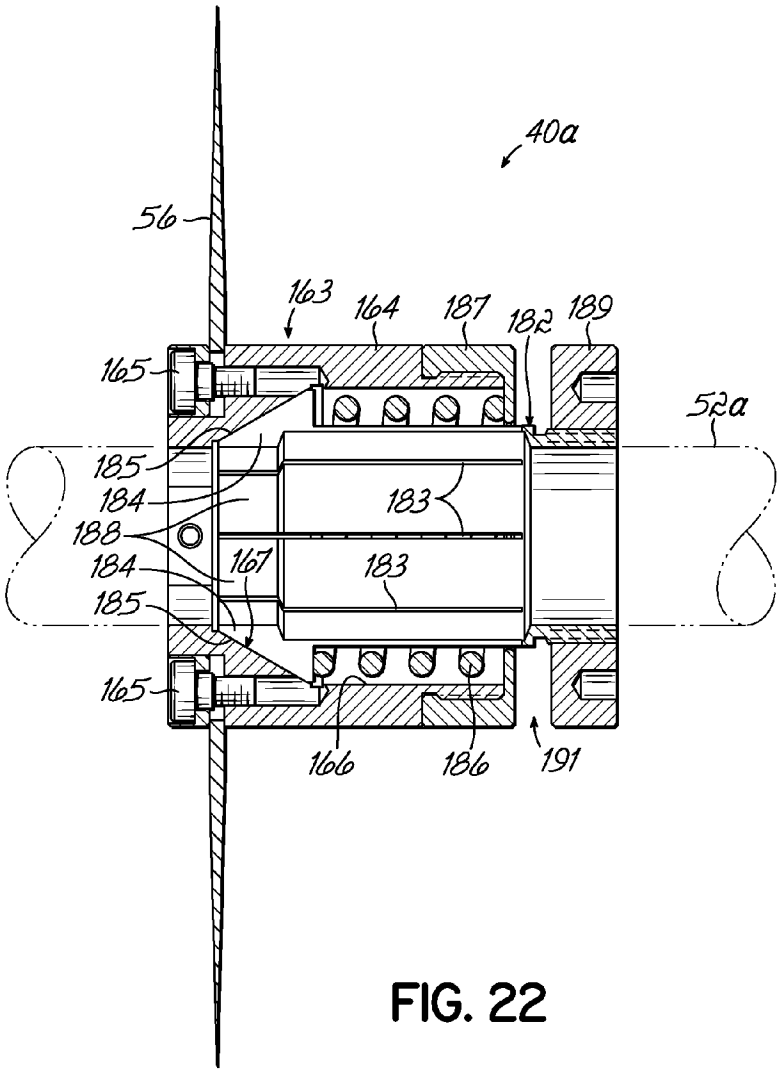
FIG. 22 is a partial cross-sectional view taken along line 22-22 in FIG. 21 of the second slitting blade assembly.
Figure 21:
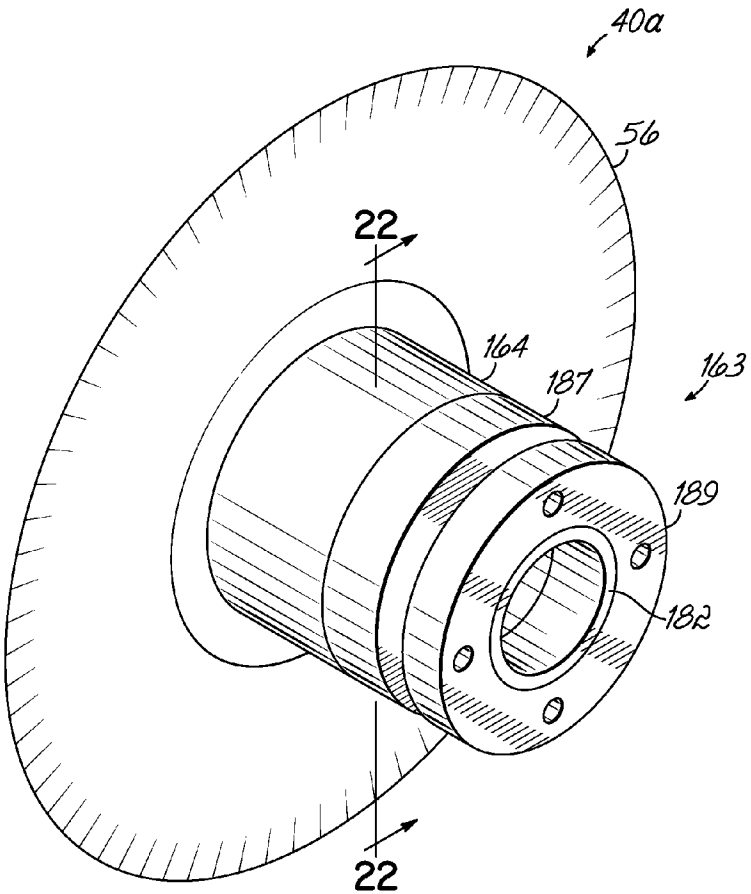
FIG. 21 is a perspective view of an exemplary alternative embodiment of a second slitting blade assembly used with the second slitting system shown in FIG. 19.

Referring to FIG. 21, each of the slitting blade assemblies 40*a* is comprised of a slitting blade 56 that is mounted to one end of a lock collar 163. As shown in FIG. 22, the slitting blade 56 is secured to a lock collar body 164 by threaded fasteners 165. The body 164 has an internal bore 166 that terminates at one end with an angled or tapered surface 167. A collet 182 is located in the bore 166. The collet 182 has longitudinally extending slits 183 that form a plurality of circumferentially spaced segments 188, which are movable in a radial direction. Flanges 184 extend from various ones of the segments 188 and have respective outer flared angled surfaces 185. The angled surfaces 185 are sized to contact against the tapered surface 167 of the body 164. The collet 182 has a center bore that is sized to receive the drive shaft 52*a*. A compression spring 186 is also located in the body bore 166 over the collet 182. A cap 187 is threaded onto an end of the collar body 164 and holds the compression spring 186 firmly against the flanges 184. The force of the compression spring 186 pushes the angled surfaces 185 against the tapered surface 167, which in turn, reacts a radial clamping force against segments 188 associated with respective flanges 184. Thus, the segments 188 are moved radially inward; and the collet 182 is pressed firmly against the drive shaft 52*a* with a force that prevents the cutting blade assembly 40*a* from rotating with respect to the drive shaft 52*a*.

A collet extension 189 is mounted by threaded engagement or a comparable connection to the collet 182 to form an annular space 191. Thus, if the collet extension 189 is moved to the right, as viewed in FIG. 22, the flanges 184 disengage from the tapered surface 167; and the segments 188 move radially outward a small amount. This radial expansion of the segments 188 releases the compressive clamping force the collet 182 was applying to the slitting blade drive shaft 52; and the slitting blade assembly 40*a* may be moved longitudinally along the drive shaft 52*a*, that is, to the right or left as viewed in FIG. 22.

Figure 23:
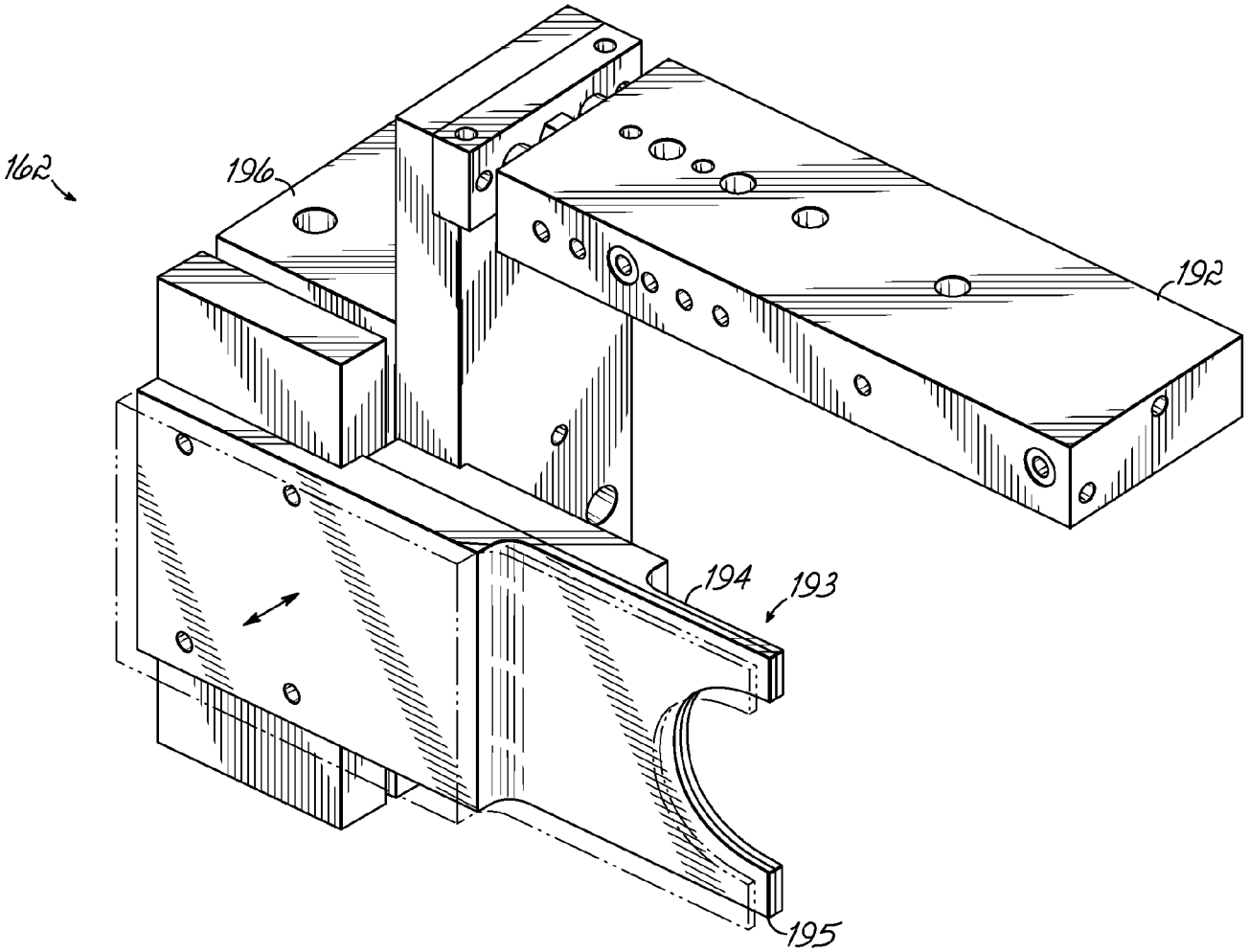
FIG. 23 is a perspective view of an exemplary alternative embodiment of a second slitting blade positioner used with the second slitting system of FIG. 19.

Referring to FIG. 23, the gripper 162 has a split fork 193 that extends toward the slitting blade drive shaft 52*a*. The split fork 193 has a first, inner fixed fork 194 that extends from the gripper 162 and a second, outer movable fork 195 that is connected to a cylinder 196. The gripper 162 further has a clearance cylinder 192 that is attached to the carriage 44*a*. Upon the control 180 providing a command that switches the state of the clearance cylinder 192, the split fork 193 is moved outward or to the left as viewed in FIG. 23 or toward a viewer in FIG. 20. At this outer position, the split fork 193 is clear of the slitting blades 56; and thus, the control 180 may command the positioning motor 46*a* to move the carriage 44*a* and gripper 162 to any desired location along the length of the drive shaft 52*a*. To relocate a slitting blade assembly 40*a* along the drive shaft 52*a*, the controller 180 commands the positioning motor 46*a* to move the griper 162 such that the fork 193 is aligned with a respective annular space 191.

The control 180 then commands the cylinder 192 to again switch states, which moves the split fork 193 inward to the right, as viewed in FIG. 23 and away from a viewer in FIG. 20, and the fork 193 is located in an annular space 191. Thereafter, the control 180 commands the cylinder 196 to switch states, which drives the movable fork 195 outward to a position shown in phantom in FIG. 23 and to the right as viewed in FIG. 20. Thus, the movable fork 195 moves the collet extension 189 and collet 182 to the right as viewed in FIGS. 20 and 22. This motion disengages the flanges 184 from the tapered surface 167 and releases the slitting blade assembly 40*a* from the drive shaft 52*a*. Thereafter, the control 180 may command the positioning motor 46*a* to move the carriage 44*a*, the gripper 162 and associated slitting wheel assembly 40*a* to any desired position along the drive shaft 52*a*.

When at a desired position, the control 180 commands the cylinder 196 to again switch states, which causes the movable fork 195 inward away from a viewer in FIG. 23 and to the left as viewed in FIG. 20. The compression spring 186 drives the flanges 184 against the tapered surface 167, which action radially deflects the flanges 184 and associated segments 188 inward toward the drive shaft 52*a*. The associated segments 188 again apply a clamping force on the drive shaft 52*a* to secure the slitting blade assembly 40*a* at the desired location on the drive shaft 52*a*. The control 180 then commands the cylinder 192 to switch states, which extends or moves the griper 162 and fixed fork 194 outward, that is, to the left as viewed in FIG. 23 and toward the viewer in FIG. 20. In that outer position, the split fork 193 clears the outer circumferences or edges of the slitting blades 56. The control 180 may then command the positioning motor 46*a* to move the carriage 44*a* and gripper 162 to any desired position along the drive shaft 52*a*.

In the embodiments shown in FIGS. 19-23, the slitting blades are not removable from the slitting blade assemblies 40*a* without removing the slitting blade assemblies from the drive shaft 52*a*. In an alternative embodiment, the slitting blade assemblies 40*a* may utilize the design shown in FIGS. 5 and 6, which permits the slitting blades 56*a* to be removed from the drive shaft 52*a* without removing the slitting blade assemblies 40*a*.

Figure 24:
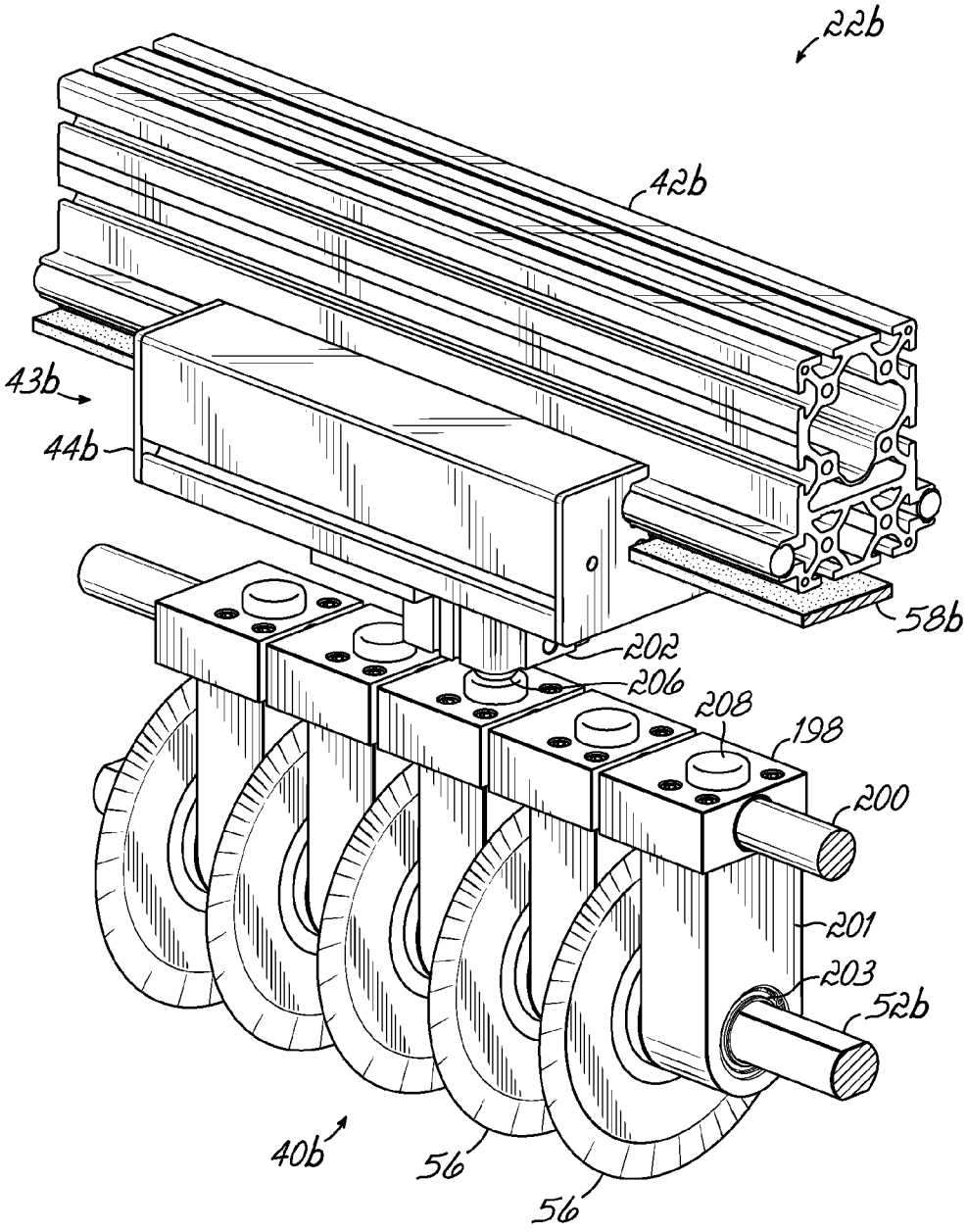
FIG. 24 is a perspective view of an exemplary alternative embodiment of a third slitting system usable with a programmable border slitter similar to that shown in FIG. 1.
Figure 25:
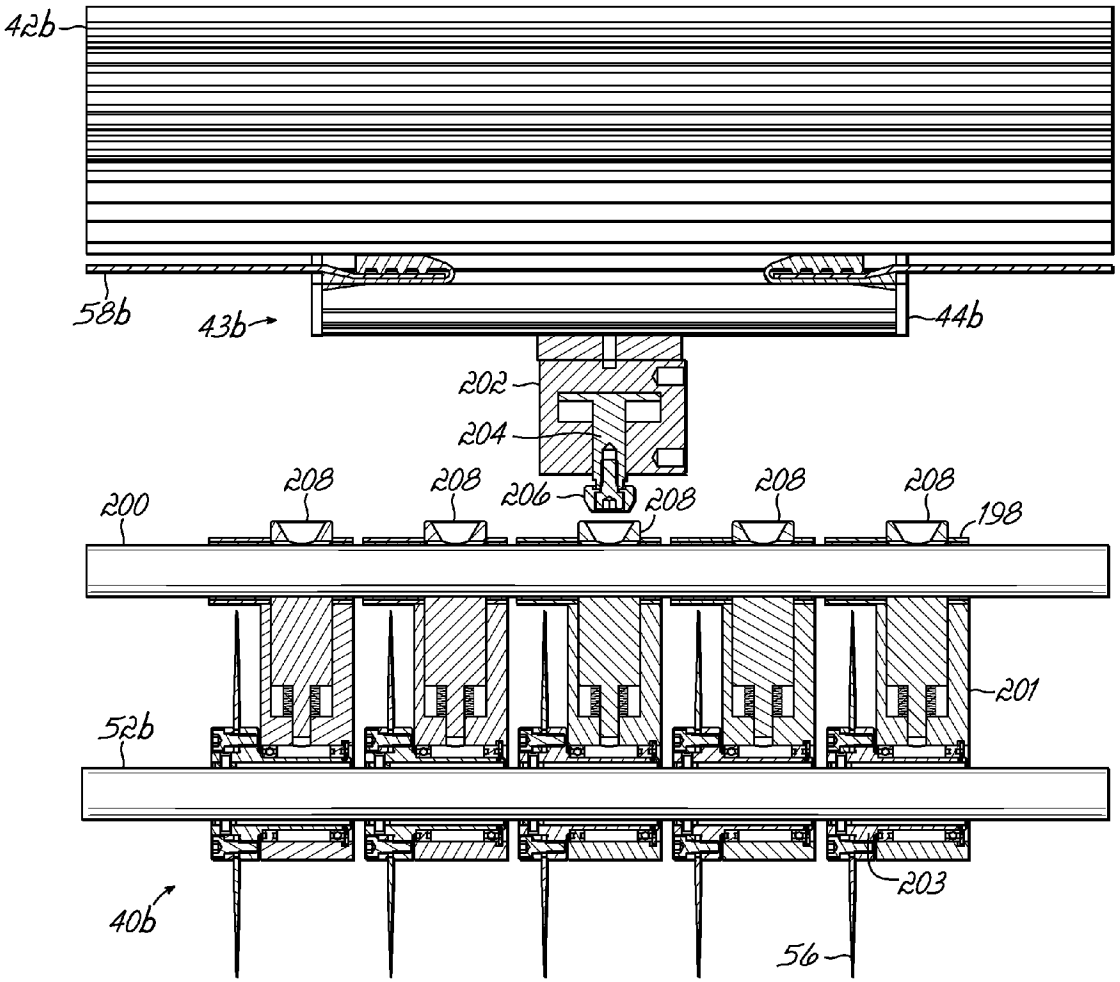
FIG. 25 is a cross-sectional view of an exemplary alternative embodiment third slitting system shown in FIG. 24.

Referring to FIG. 24, in another exemplary alternative embodiment, a slitting blade system 22*b* includes a slitting blade positioner 43*b* that is slideably mounted on a support bar assembly 42*b*. The slitting blade positioner 43*b* is connected to a pulley and belt drive 58*b* that is driven by a positioning motor in a manner similar to that previously described with respect to positioning motor 46*a* of FIG. 19. Another exemplary alternative embodiment of slitting blade assemblies 40*b* are mounted for sliding motion on a slitting blade drive shaft 52*b* having a non-circular cross-sectional profile. Each slitting blade assembly 40*b* has a guide block 198 mounted for sliding motion on a guide shaft 200. Each guide block 198 has a respective mounting bracket 201 extending therefrom, and each mounting bracket has a bearing assembly 203 sized to slidingly receive a drive shaft 52. As shown in FIG. 25, the bearing assembly 203 permits a respective slitting blade assembly 40*b* to be moved to different positions longitudinally on the drive shaft 52*b* and guide shaft 200 by the slitting blade positioner 43*b*. The bearing assembly 203 further provides a respective slitting blade mount that permits the respective slitting blade to be mounted thereto and rotated by the drive shaft 52*b*.

Referring to FIGS. 24 and 25, the slitting blade positioner 43*b* includes a carriage 44*b* slideably mounted on the support bar assembly 42*b*. The carriage 44*b* supports a cylinder 202 that is effective to engage the slitting blade assemblies 40*b* for movement along the drive shaft 52*b* and guide shaft 200. The cylinder 202 has a piston 204 with a plunger 206 on its distal end. The plunger may be resiliently mounted on the distal end of the piston 204. The cylinder 202 is operable by the programmable control 180 of FIG. 13 to extend and retract the piston 204 and plunger 206. Each of the cutting blade assemblies has a receptacle 208 with a generally flared cross-sectional profile that is effective to receive a generally tapered cross-sectional profile of the plunger 206. Thus, the control 180 first moves the carriage 44*b* so that the plunger 206 is adjacent to a desired receptacle 208. The cylinder is then commanded to extend the piston 204, which inserts the plunger 206 into the adjacent receptacle 208. The control 180 is then operable to move the carriage 44*b* and one or more of the cutting blade assemblies 40*b* to a different longitudinal position with respect to the drive shaft 52*b* and guide shaft 200. The control 180 stops the carriage 44*b* and the one or more cutting blade assemblies 40*b* at the desired position and commands the cylinder 200 to change state and retract the piston 204 and plunger 206. Thus, the carriage 44*b* and cylinder 200 are operable to move each of the cutting blade assemblies to respective desired positions with respect to the cutting blade drive shaft 52*b* and guide shaft 200.

Figure 26A:
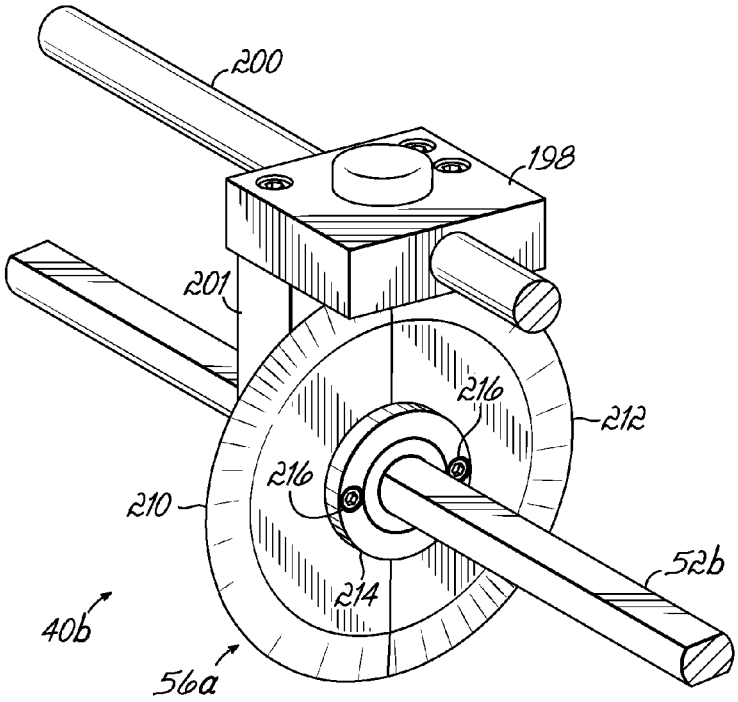
FIG. 26A is a partial perspective view showing an exemplary embodiment of a split slitting blade mounted on a slitting blade drive shaft.
Figure 26B:
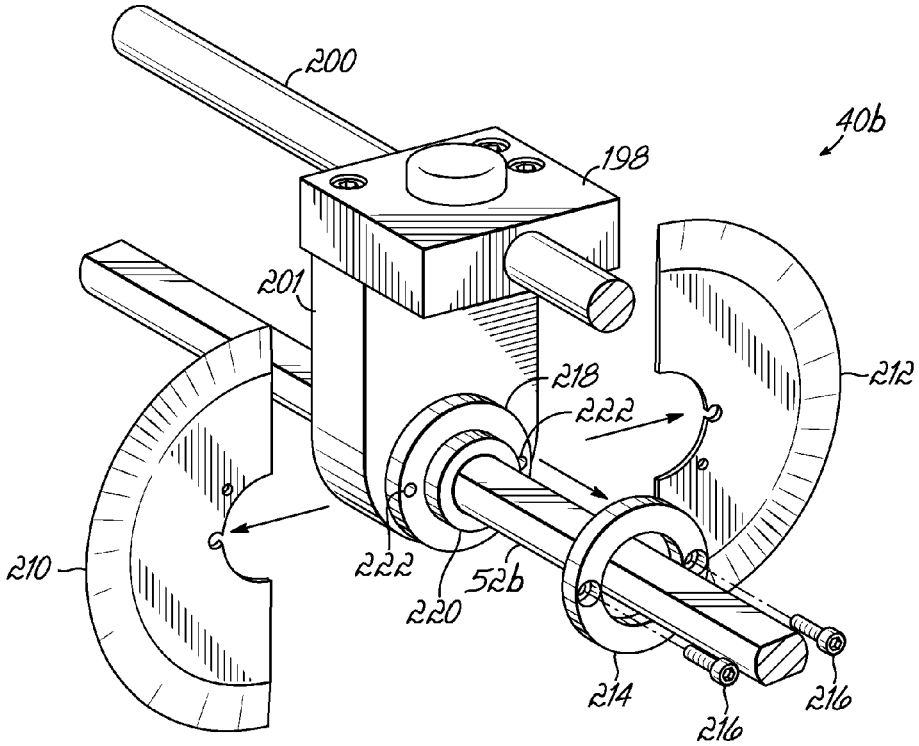
FIG. 26B is a partial perspective view showing the split slitting blade of FIG. 26A removable from the slitting blade drive shaft.

Referring to FIG. 26A, an exemplary alternative embodiment of a slitting blade 56*a* has two slitting blade halves 210, 212 that are secured in place by a locking collar 214 and fasteners 216. As shown in FIG. 26B, upon removing the fasteners 216, upon a slight sliding motion of the locking collar 214, the slitting blade halves may be removed. The removed position of the locking collar 214 is exaggerated in FIG. 26*b* for clarity. A blade mount 218 is part of a bearing assembly 203 within the mounting bracket 201 and shown FIG. 25. The blade mount 218 has a central hub 220 for locating the blade halves 210, 212 and locking collar 214. The blade mount 218 further has threaded holes for receiving the fasteners 216. The slitting blade 56*a* has an advantage of permitting a slitting blade to be removed from, and mounted on, the slitting blade assembly 40*b*, without having to remove the slitting blade assembly 40*b* from the drive shaft 52*b*. The slitting blade 56*a* may be used with any of the slitting blade assemblies described herein.

In the exemplary embodiments described above, the slitting blade positioning systems 23, 23*a* are mounted to respective support bar assemblies 42, 42*a*; however, in other embodiments, the slitting blade positioning assembly may be mounted to another guiding structure.

Figure 27A:
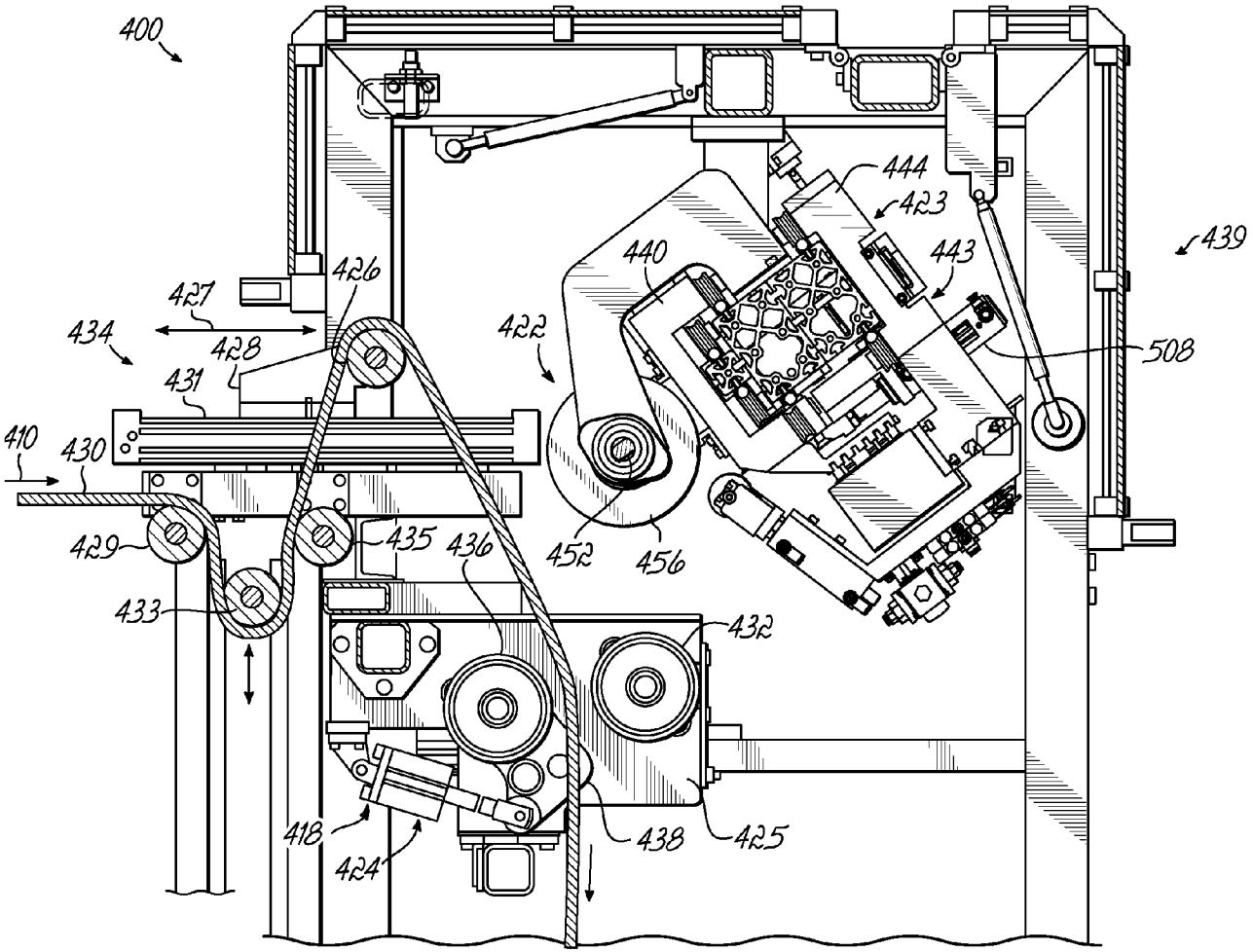
FIG. 27A is a cross-sectional side view of an alternative embodiment of programmable border slitter.
Figure 27B:
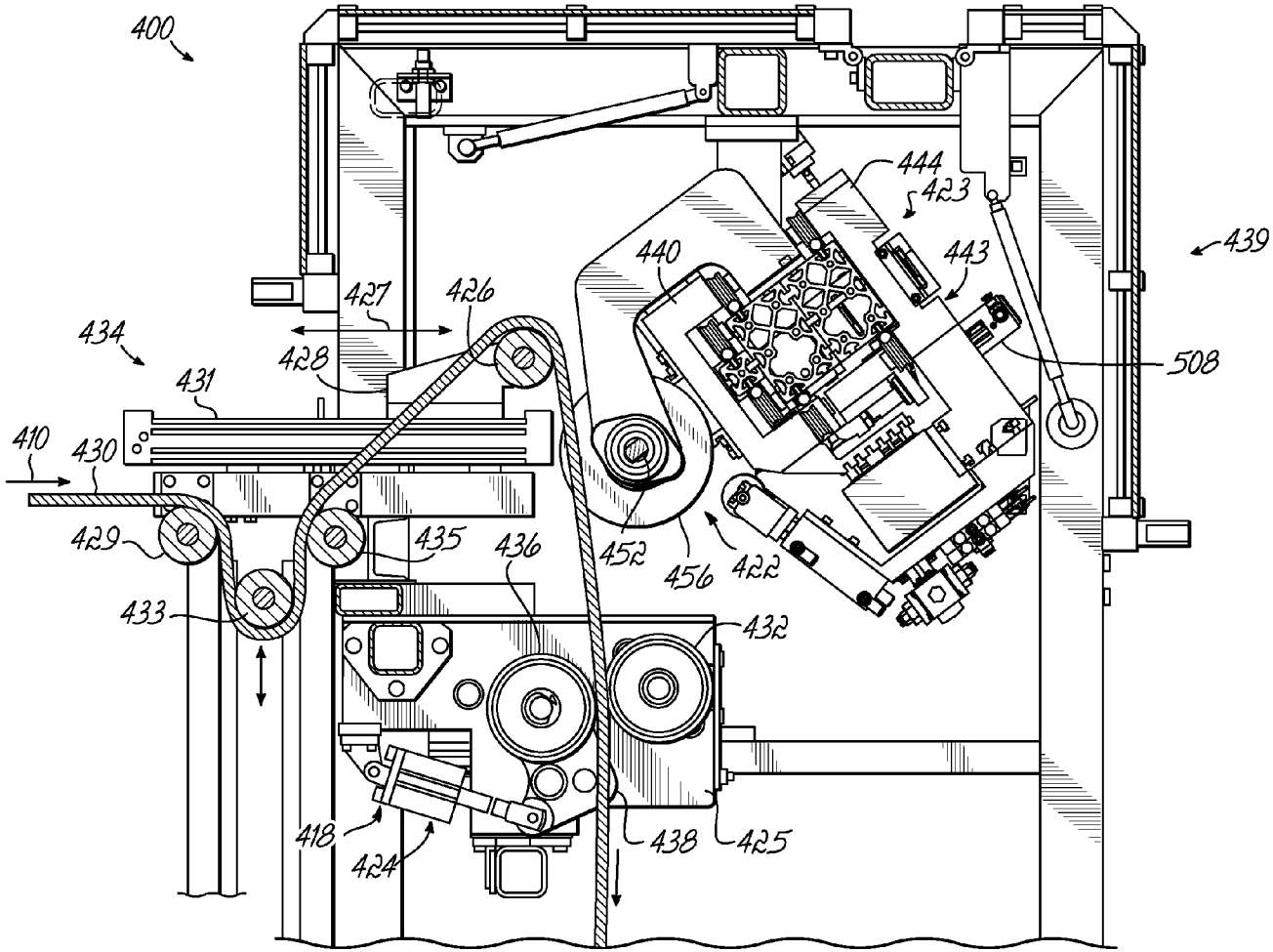
FIG. 27B is another cross-sectional side view of the embodiment of programmable border slitter of FIG. 27A showing the material moving through the slitter and being slit.

FIGS. 27A-38 illustrate an alternative embodiment of programmable border slitter 400 which includes exemplary embodiments of a slitting system 422, a slitting blade positioning system 423, a material feed system 424 and a cross cutter system 428. Material 230 to be slit is fed through the programmable border slitter 400 from left to right as shown in FIGS. 27A and 27B as indicated by the arrow 410. The material 430 is only a representative showing; and in practice, either single pieces or a stack of soft goods may be cut. A downstream direction means a direction the same as the direction of material flow arrow 410, and an upstream direction mean a direction opposite the direction of material flow arrow 410. Further, the border slitter 400 has a front 434 into which the material 430 is fed and a back 439. Depending on the application, the border slitter 400 may be supported on a base or frame (not shown) in a generally horizontal orientation as shown in FIGS. 27A and 27B or alternatively, in a generally vertical orientation.

Figure 28:
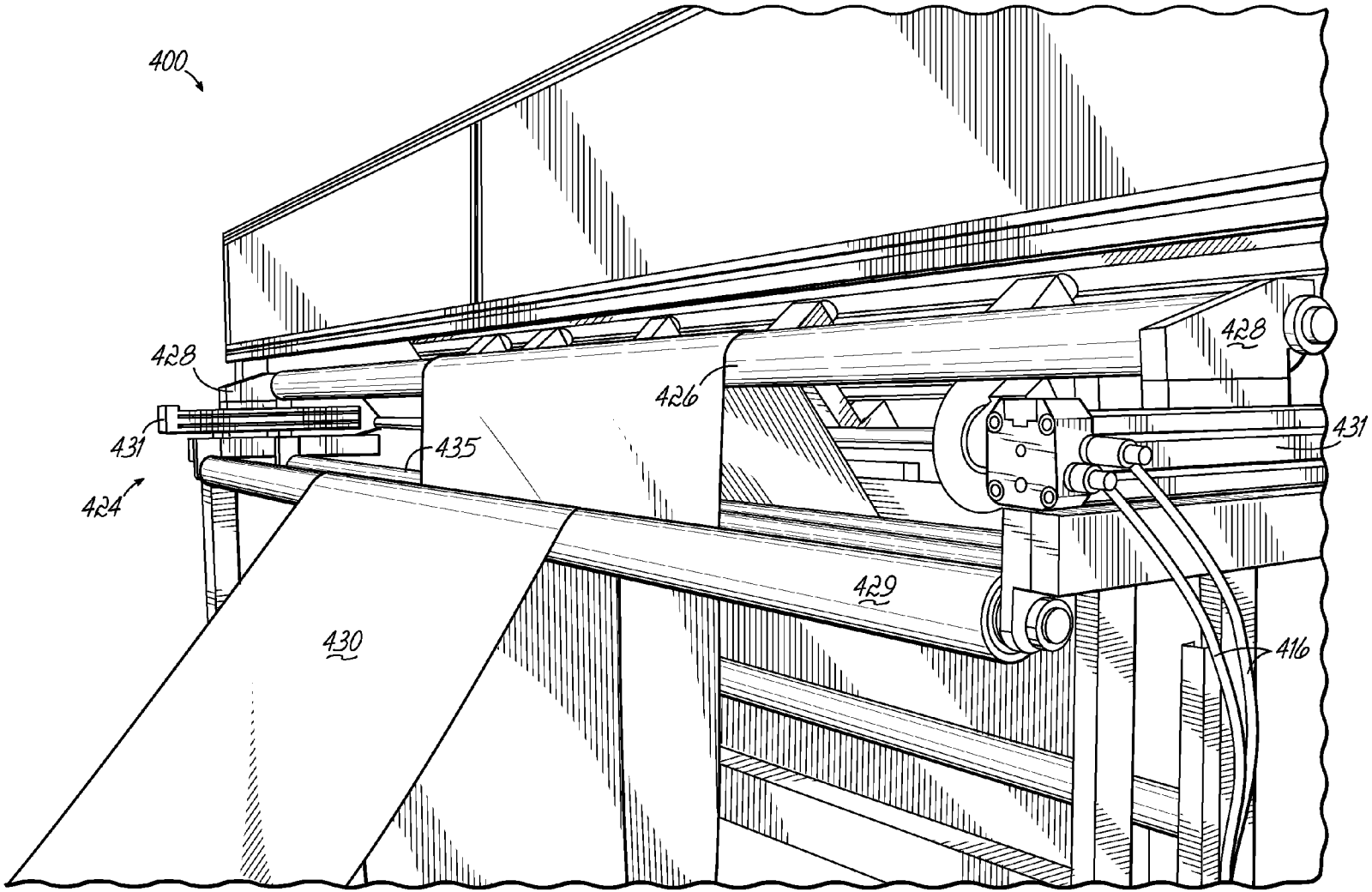
FIG. 28 is a perspective view showing a portion of the material feed system generally in front of the cross rail of the programmable border slitter of FIGS. 27A and 27B.

FIGS. 27A, 27B, 28 and 29 illustrate the material feed system 424. As shown in FIGS. 27A and 27B, the material 430 to be slit passes over a first stationary idler roller 429, under a movable dancer roller 433, which may be raised and lowered as desired, and along a second stationary idler roller 435 before passing over a movable engagement roller 426 and then between a feed roller 432 and a movable pinch roller 436 from which the material 430 exits the border slitter 400. As shown in FIG. 28, the slitting engagement roller 426 is rotatably mounted at its ends to respective ends of support brackets 428 that, in turn, are mounted to respective pneumatic members or cylinders 431 which function to move the slitting engagement roller 426. FIG. 28 illustrates hoses 416 extending from an air supply (not shown) to the pneumatic members or cylinders 431 for changing the location of the slitting engagement roller 426 from the position shown in FIG. 27A to the position shown in FIG. 27B. The support brackets 428 and engagement roller 426 extending therebetween are movable from a first non-engaged position shown in FIG. 27A in which the material 430 is spaced away from slitting blades 456 and a second or engaged position shown in FIG. 27B in which the material 430 is being slit or cut.

As shown in FIG. 27A, when material 430 is being loaded into the border slitter 400 or in other situation in which the operator desires, the support brackets 428 and engagement roller 426 travel rearward in the direction of the arrow 427 due to activation of two pneumatic members 431 to their first position, the slitter engagement roller 426 supporting the material 430 at a position removed from a slitting blade 456. However, as shown in FIG. 27B, when the pneumatic members 431 are further activated, the slitter engagement roller 426 and associated support brackets 428 are moved toward the slitting blade 456; and the material 430 is moved to a position engaging the slitting blade 456.

Figure 29:
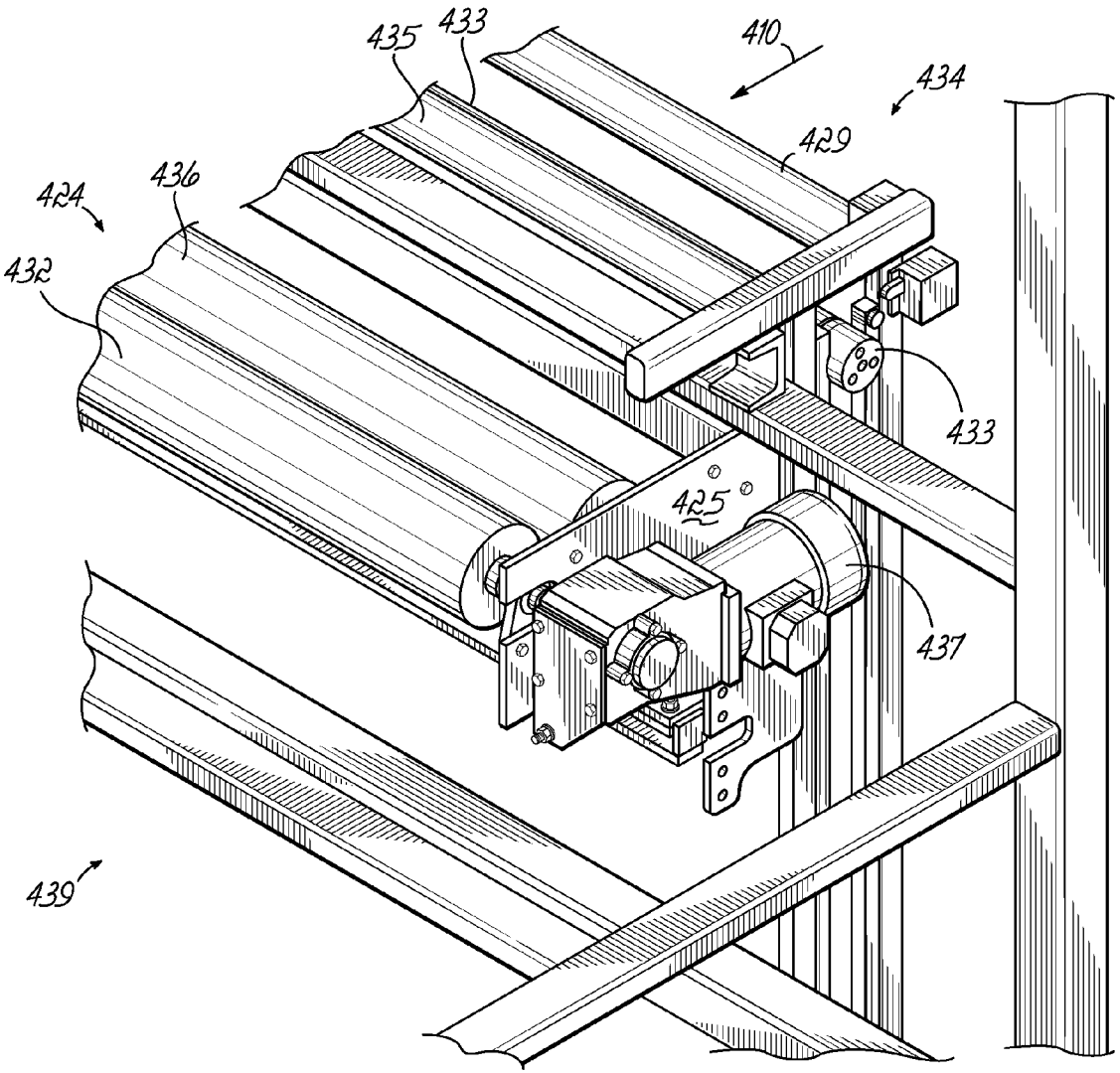
FIG. 29 is a perspective view showing another portion of the material feed system generally below the cross rail of the programmable border slitter of FIGS. 27A and 27B.

Referring to FIG. 29, material feed system 424 further comprises a feed or puller roller 432 rotated by a material feed motor 437. A pinch roller 436 is rotatably mounted at its ends to respective ends of angle brackets 438 (shown in FIGS. 27A and 27B) that, in turn, are pivotally mounted to respective frame members 425 (only one being shown in FIGS. 27A, 27B and 29). Pinch roller cylinders or solenoids 418 (only one being shown in FIGS. 27A and 27B), which may be pneumatic or electric, are also supported by respective frame members 425 and are pivotally connected to opposite ends of the respective pivotal angle brackets 438. As shown in FIG. 27A, when the pinch roller cylinders 418 are in a first position or state, the pinch roller 436 supports the material 430 at a position removed from puller or feed roller 432; and the material 430 is not pulled through the border slitter 400. However, as shown in FIG. 27B, when the pinch roller cylinders 418 switch positions or states to a second position, the pinch roller 426 is pivoted toward and contacts the material 430 supported by the feed or puller roller 432; and the material 430 is pulled through the border slitter 400.

Figure 30:
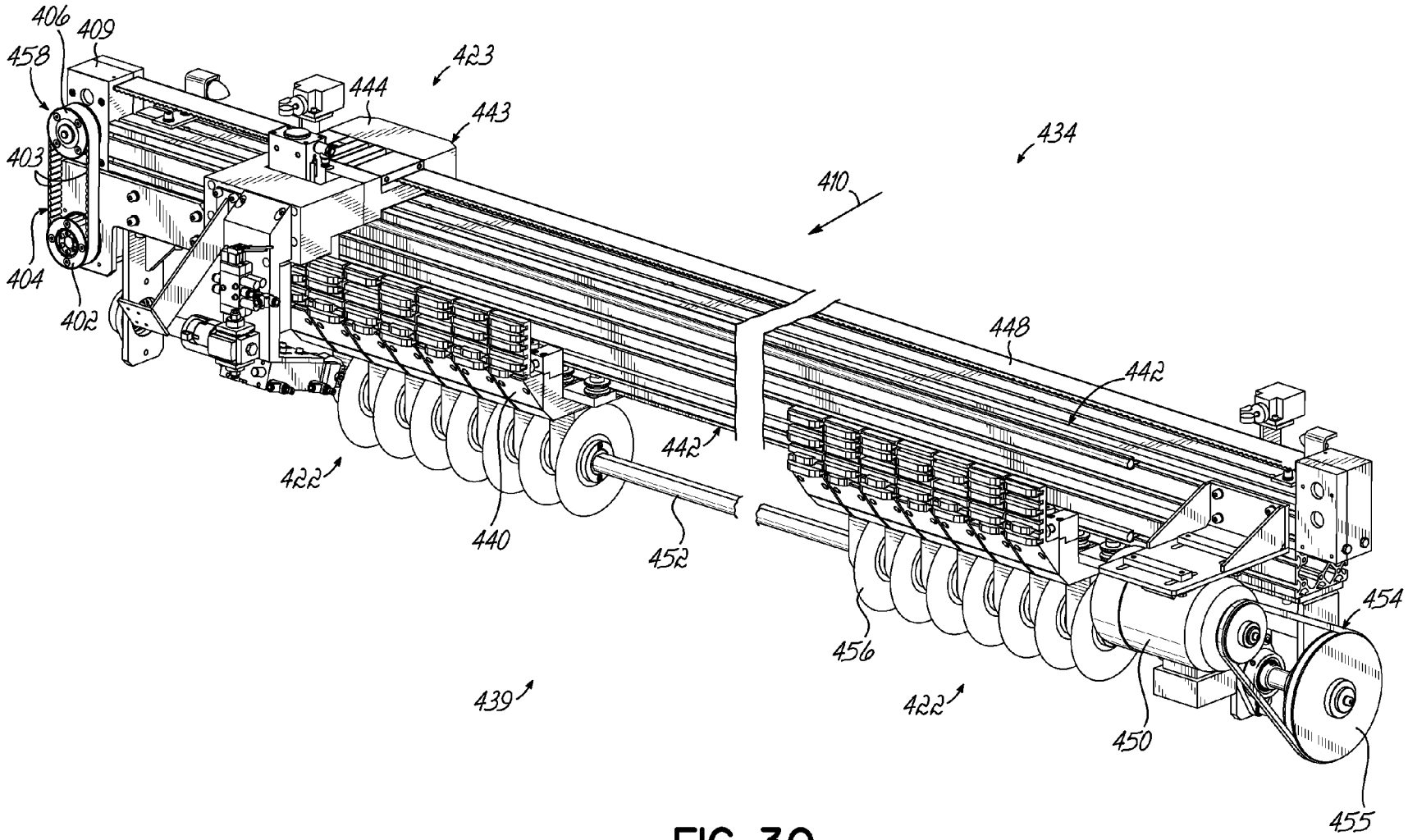
FIG. 30 is a rear perspective view of a portion of the programmable border slitter of FIGS. 27A and 27B.

Referring to FIG. 30, the slitting system 422 includes a plurality of slitting blade assemblies 440 that are moveably mounted on a support bar assembly 442 that extends across a width of the border slitter 400. The slitting blade positioning system 423 has a slitting blade positioner 443 that includes positioning carriage 444, which is also mounted on the support bar assembly 442. The positioning carriage 444 is connected to a drive belt 448 that is part of a belt and pulley drive 458 as shown in FIG. 30 operated by a servo motor 446 shown in FIG. 31, which is operable to move the positioning carriage 444 to different positions on the support bar assembly 442. Thus, the support bar assembly 442 functions as a cross rail or track for the slitting blade assemblies 440 and the slitting blade positioning carriage 444. As shown in FIG. 30, a slitting blade drive or drive shaft motor 450 rotates a slitting blade drive pulley 455 and drive shaft 452 by means of a pulley and belt drive 454. In this embodiment, all of the slitting blades 456 are rotated by a common drive shaft 452.

Figure 31:
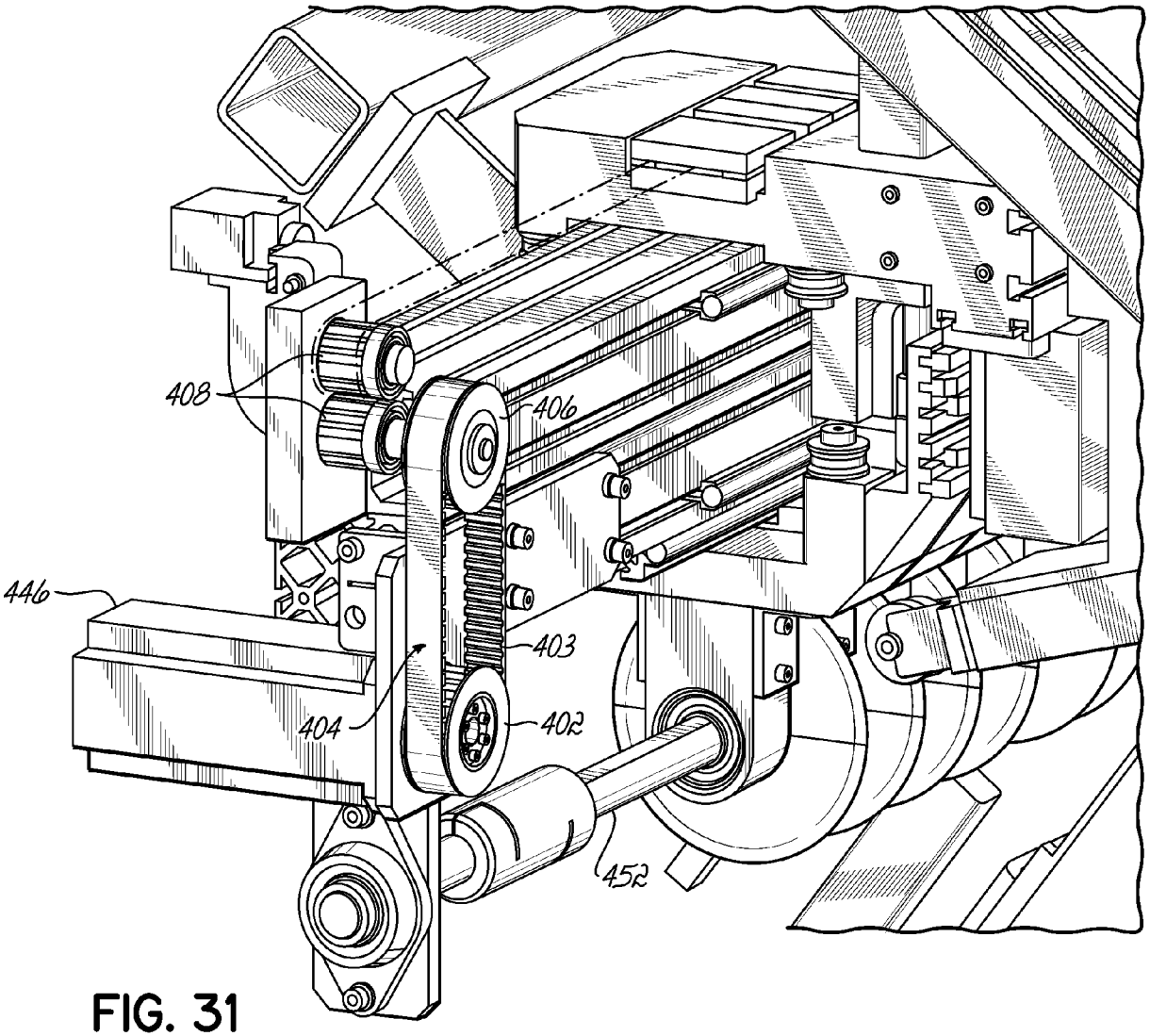
FIG. 31 is a partial perspective view showing a portion of the belt and pulley drive used to move the slitting blade positioning system relative to the stationary support bar assembly.

Referring to FIG. 31, a servo motor 446 rotates a first or lower pulley 402 having a plurality of external teeth which engage the teeth 403 of a drive belt 404 and cause rotation of the drive belt 404. The teeth 403 of drive belt 404 engage the external teeth of another pulley 406 and cause rotation of upper or second pulley 406. Rotation of pulley 406 rotates a pair of drive wheels 408 inside a casing 409 (removed from FIG. 31 for clarity but shown in FIG. 30), the drive wheels 408 having external teeth which engage the internal teeth of drive belt 448. As shown in FIG. 30, the slitting blade positioning carriage 444 is secured to a specific location on the drive belt 448, like positioning carriage 44 is secured to drive belt 48 as described and illustrated herein or any like manner.

Figure 32:
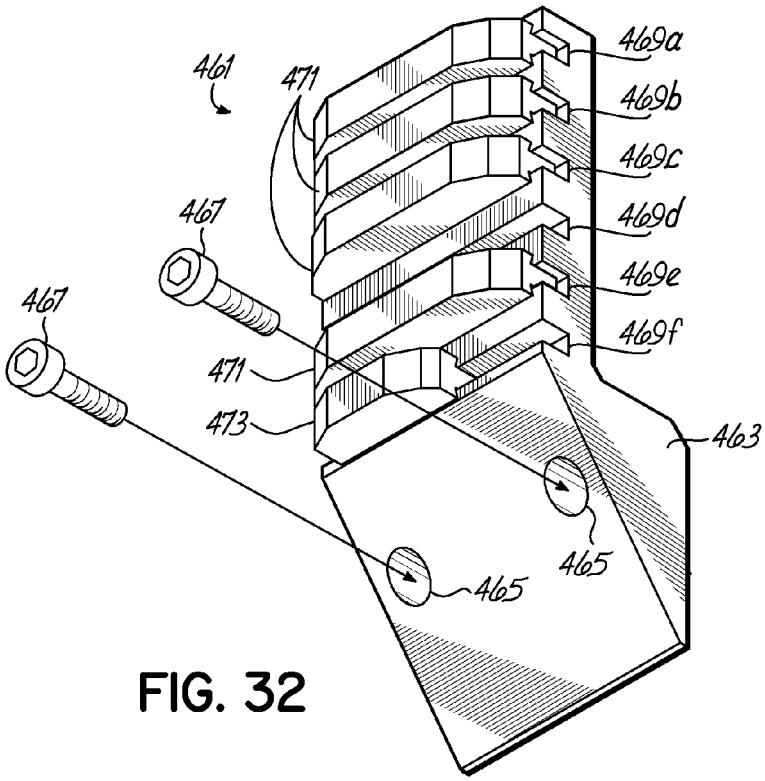
FIG. 32 is a perspective view of a cam assembly of the slitting blade assembly of FIG. 34.

Each of the slitting blade assemblies 440 is substantively identical except for a portion thereof referred to herein as the cam assembly 461 shown in FIG. 32. Each cam assembly 461 is unique and functions to identify each slitting blade assembly 440 individually to a programmable control 580. However, only a single slitting blade assembly 440 shown assembled in FIG. 32 will be shown and described in detail. Thus, each slitting blade assembly 440 shown in FIG. 30 is different because each has its own unique cam assembly adapted to be identified by the sensors 511 on the slitting blade positioner 443 shown in FIG. 36.

Figure 33:
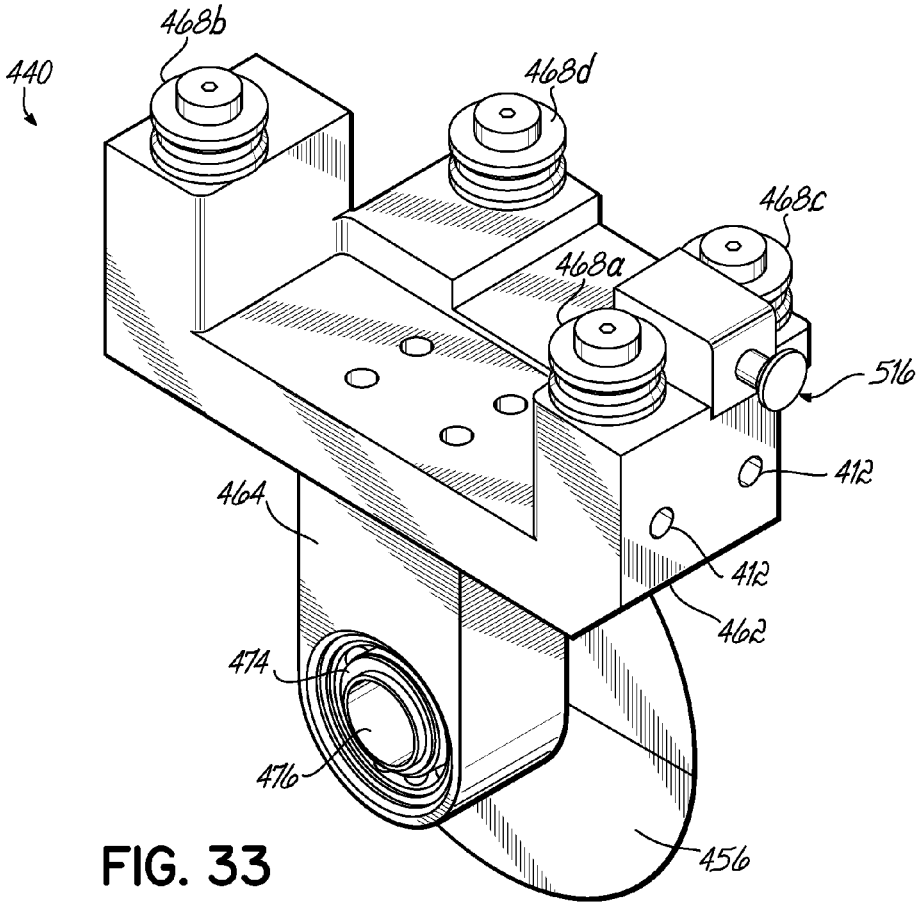
FIG. 33 is a perspective view of a portion of the slitting blade assembly of FIG. 34.
Figure 34:
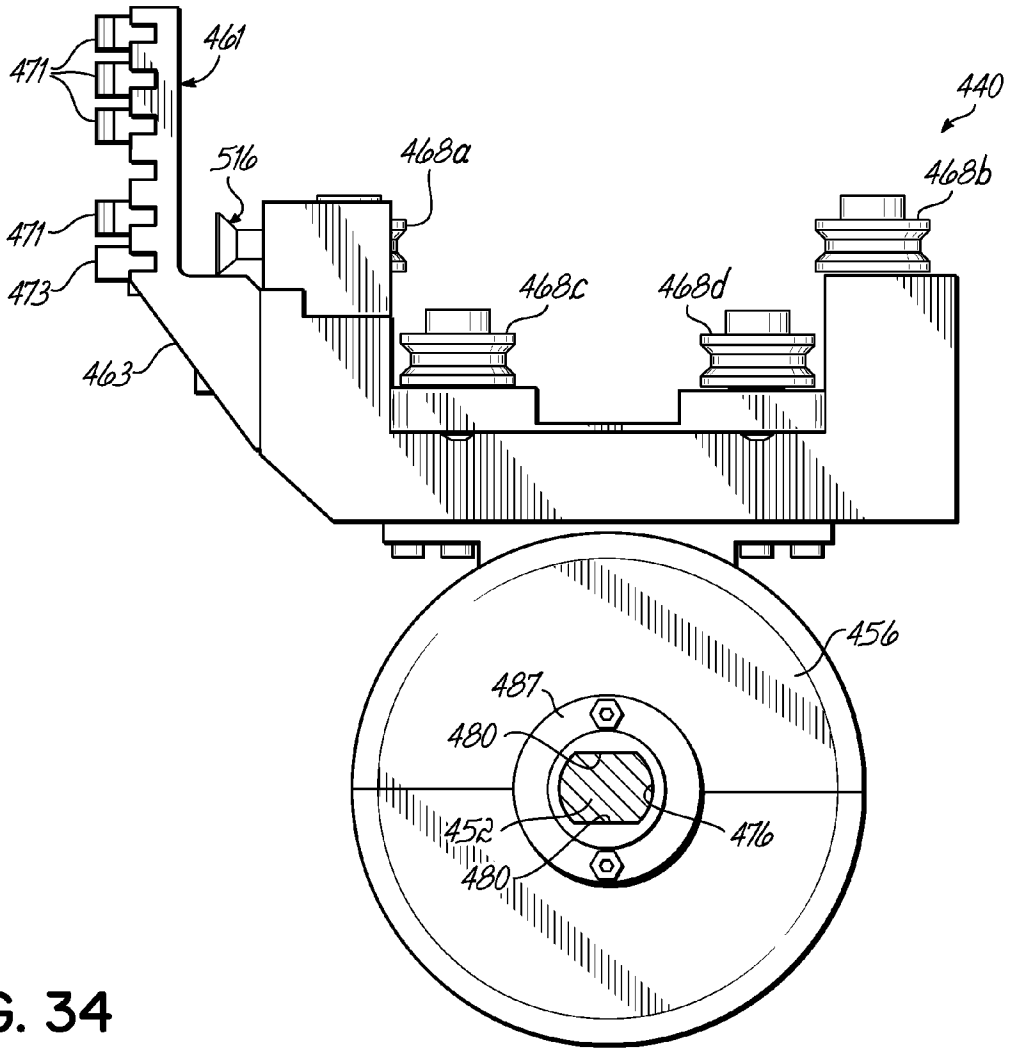
FIG. 34 is a perspective view of an assembled slitting blade assembly.

Referring to FIGS. 32-34, each slitting blade assembly 440 comprises its own unique cam assembly 461, one exemplary cam assembly 461 being shown in detail in FIGS. 32 and 34. Referring to FIG. 33, in addition to the cam assembly 461, the slitting blade assembly 440 comprises a mounting bracket 462, a slitting blade mount 464 secured to the mounting bracket 462 and a slitting blade 456 rotatable secured to the slitting blade mount 464.

Referring to FIG. 32, cam assembly 461 includes a cam block 463 which has two holes 465 therethrough used for fasteners 467 to attach the cam assembly 461 to the guide block 462, as shown in FIG. 34. The fasteners 467 pass through holes 465 in the cam block 463 and into holes 412 in the guide block 462. The catch block 463 has six horizontally oriented slots 469*a-f*. Long metal cams 471 fit into the upper four slots 469*a-f*. The top four slots 469*a-d* receive either long metal cams 471 or no cam at all. The combination of long cams or no cams at all in the top four slots identify the "blade name" and function as the blade identifier to the programmable controller when sensed by the sensors 511 in the movable slitting blade positioner 443 (see FIG. 36). Because each of the slots 269*a-d* can have either a long cam 471 or no cam at all, there are a total of 16 combinations (2×2×2×2) which function to identify a slitting blade assembly 440. Therefore, the maximum number of slitting blade assemblies 440 is 16, even though only 14 slitting blade assemblies 440 are shown in FIG. 30, seven per side.

FIG. 32 illustrates a combination of long cams 471 in slots 269*a-c*, and no cam in slot 269*d*. FIG. 32 further illustrates a long cam 471 in slot 469*e* and a short cam 473 in lowermost slot 469*f*. The cams in the lower two slots 469*e-f* are related to the speed of the movable slitting blade positioner 443 (see FIG. 36). On each of the slitting blade assemblies 440, one of the lower two cams is long, the other is short. The sensors 511 in the movable slitting blade positioner 443 (see FIG. 36) recognize the longer cam and slow down the positioner 443 to a slower speed. When the positioner 443 reaches the shorter cam 473, the positioner 443 stops so it may pick up one of the slitting blade assemblies 440 and move it if necessary.

Each cam assembly 461 corresponding to each slitting blade assembly 440 has a unique combination which identifies the slitting blade assembly 440 to the programmable controller or control. FIG. 32 shows only one example of the many combinations which may identify one of the many slitting blade assemblies 440. This unique method of identification of each slitting blade assembly 440 allows the slitting blade positioner 443 to engage and move one or more of the slitting blade assemblies 440 to a desired position along the support bar assembly 442.

Referring to FIG. 33, the slitting blade assembly 440 further comprises four guide rollers 468*a*-468*d* mounted on the guide block 462. The guide rollers 468*a*-468*d* engage the support bar assembly 442 and are freely rotatable with respect to the remainder of the slitting blade assembly 440. The slitting blade mount 464 is attached to the guide block 462 and extends below the guide block 462, as shown in FIG. 33.

The slitting blade mount 464 has a drive collar 474 that is mounted in bearings and thus, freely rotatable with respect to the slitting blade mount 464. The central bore or spindle 476 has opposed keys 480. The keys 480 are separated by a distance permitting the drive shaft 452 to slide therebetween. The drive shaft 452 has a non-circular cross section, for example, a square, hexagonal, octagonal or other non-circular cross section; and thus, the drive collar 474 is rotated by the drive shaft 452. The slitting blade 456 is mounted on one end of the spindle 476 and is held in place by a nut 487 that is threaded onto the opposite end of the spindle 476. Thus, the slitting blade 456 may be easily replaced by simply removing the nut 487.

Figure 35:
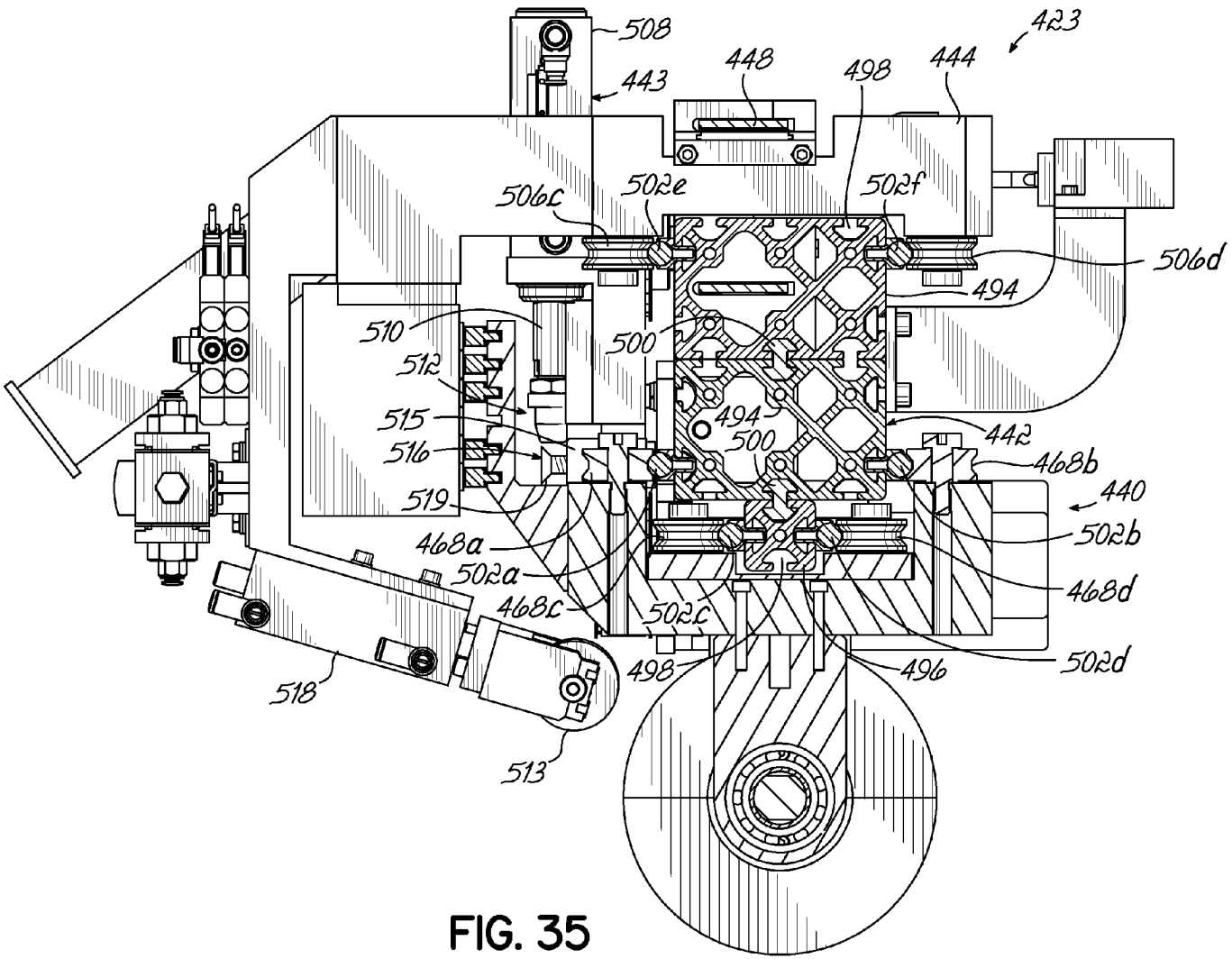
FIG. 35 is a perspective view of a cam assembly used on the slitting blade assembly of FIG. 34.

Referring to FIG. 35, the support bar assembly 442 is made up of two large support bars 494, one on top of the other, and a small support bar 496. The support bars 494, 496 are commercially available aluminum extrusions. The support bars 494, 496 have a plurality of lengthwise T-slots 498 located about a cross-sectional perimeter, and the support bars are connected together by fasteners, two of which are shown at 500, which are also commercially available for that purpose. A plurality of linear guide rails 502*a*-502*f* are inserted in selected T-slots 498 and held in place by a friction fit. The guide rails 502*a*-502*f* are also commercially available parts that are designed to be used with the support bars 494, 496. A slitting blade system 440 is mounted on the support bar assembly 442 by sliding the guide rollers 468*a*-468*d* (see FIG. 33) over respective guide rails 502*a*-502*d*, thereby allowing the slitting blade system 440 to be easily moved lengthwise along the support bar assembly 442. As shown in FIG. 30, the support bar assembly 442 has a length that permits slitting blade assemblies 440 not being used to be stored at one or both ends of the support bar assembly 442 in idle positions. Referring to FIG. 33, guide rollers 468*a*, 468*b* have a wider separation than guide rollers 468*c*, 468*d* to minimize any tendency of the slitting blade system 440 to rock or bind when mounted on the support bar assembly 442 as shown in FIG. 35.

Figure 36:
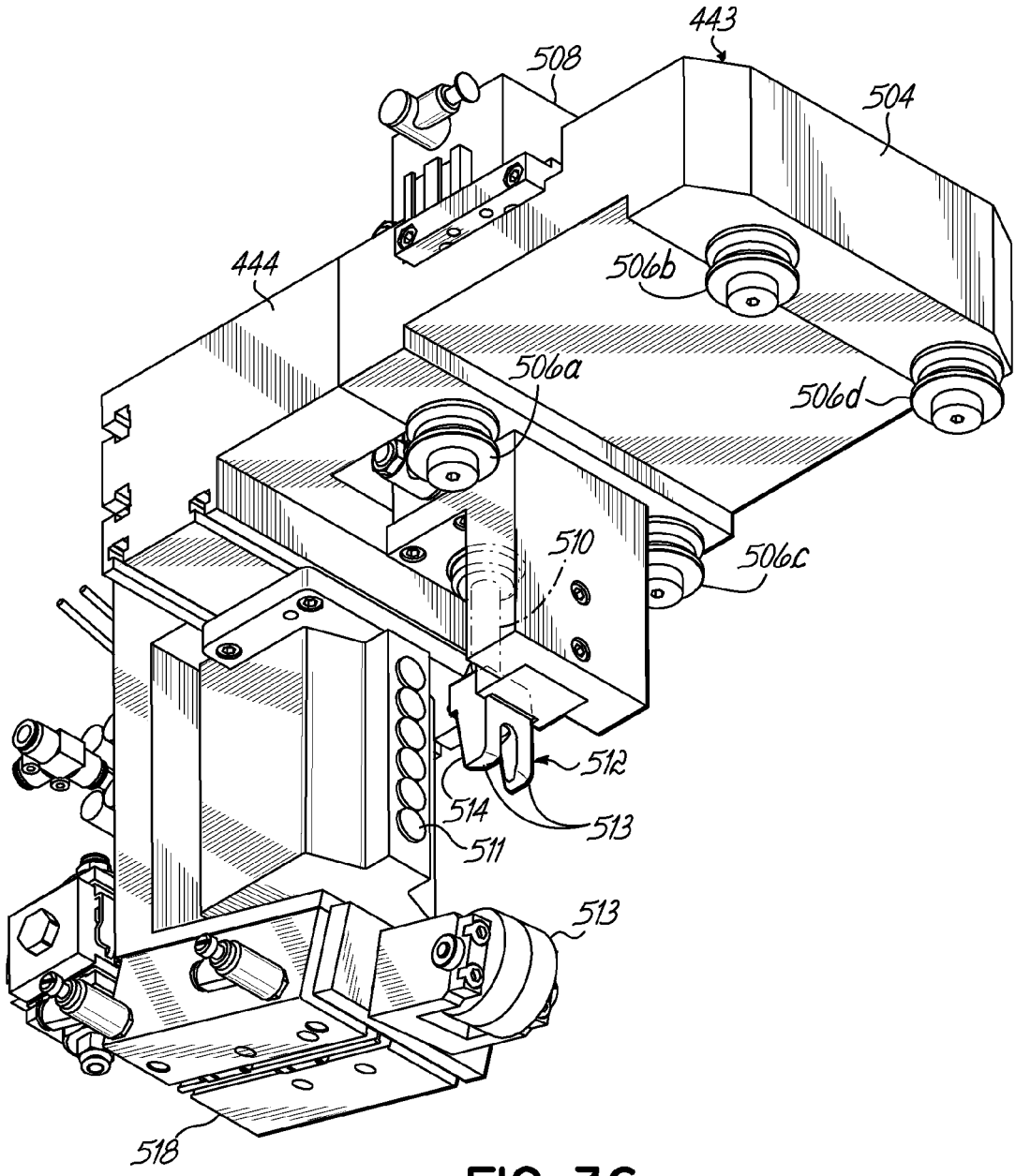
FIG. 36 is a perspective view of the slitting blade positioner of the programmable border slitter of FIGS. 27A and 27B.

Referring to FIG. 36, the positioning carriage 444 of the slitting blade positioner 443 has a body 504 on which are rotatably mounted four roller guides 506*a*, 506*b*, 506*c*, 506*d*. A slitting blade pickup cylinder or solenoid 508, which may be pneumatic or electric, is connected at one end of the body 504. The cylinder 508 is operable to extend and retract a cylinder rod 510. A generally U-shaped claw 512 is connected to a distal end of the cylinder rod 510. The claw 512 has opposed legs or fingers 413*a*, 513*b* with respective forward edges 514 that taper toward a distal end of the claw 512. The positioning carriage 444 has six aligned sensors 511 for detecting the metal cams or absence thereof in the slots 469*a-f* of one or more of the slitting blade assemblies 440. A blade sharpener 513 is attached to the bottom of the positioning carriage 444 and may be moved forward via a pneumatic cylinder 518.

Referring back to FIG. 35, the positioning carriage 444 is mounted on the support bar assembly 442 by sliding the guide rollers 506*a*, 506*c* over linear guide rails 502*e* and guide rollers 506*b*, 506*d* over linear guide rail 502*f*. Thus, the positioning carriage 442 is freely movable lengthwise along the support bar assembly 442.

The slitting blade system 440 also has a locking pin 516 that is connected to a collar 515, for example, by threads, pinning or a comparable connection. A biasing device, like spring 117 shown in FIG. 7, for example, a compression spring, one or more Belleville washers or comparable biasing device, is used to create a biasing force against the collar 515 toward the guide rail 502*a*. Thus, the biasing means causes the collar 515 and pin 516 to apply a locking force against guide rail 502*a*, thereby preventing the slitting blade system 440 from moving with respect to the support bar assembly 442. Upon actuating the slitting blade pickup cylinder 508, the cylinder rod 510 and fingers 513 extend toward the locking pin 516. The tapered forward edges 514 of the respective fingers 513 contact the angled surface 519 of the locking pin 516; and upon the cylinder rod 510 and fingers 513 being fully extended, the claw 512 moves the collar 515 and locking pin 516 to the left as viewed in FIG. 35. Thus, as shown in FIG. 36, the fingers 513 lift the collar 515 and locking pin 516 from contact with the guide rail 502*a*. Upon actuation of the servo motor 446 (FIG. 31), the positioning carriage 444 and slitting blade system 440 are movable lengthwise along the support bar assembly 442. When the positioning carriage 444 has moved the slitting blade system 440 to a desired position, the state of the slitting blade pickup cylinder 508 is switched; and the cylinder rod 510 and fingers 513 are retracted to the positions shown in FIG. 35. The biasing means moves the collar 515 and locking pin 516 to the right as viewed in FIG. 35 and into contact with the guide rail 502*a*, thereby preventing the slitting blade system 440 from moving with respect to the guide rail 502*a*.

Figure 37:
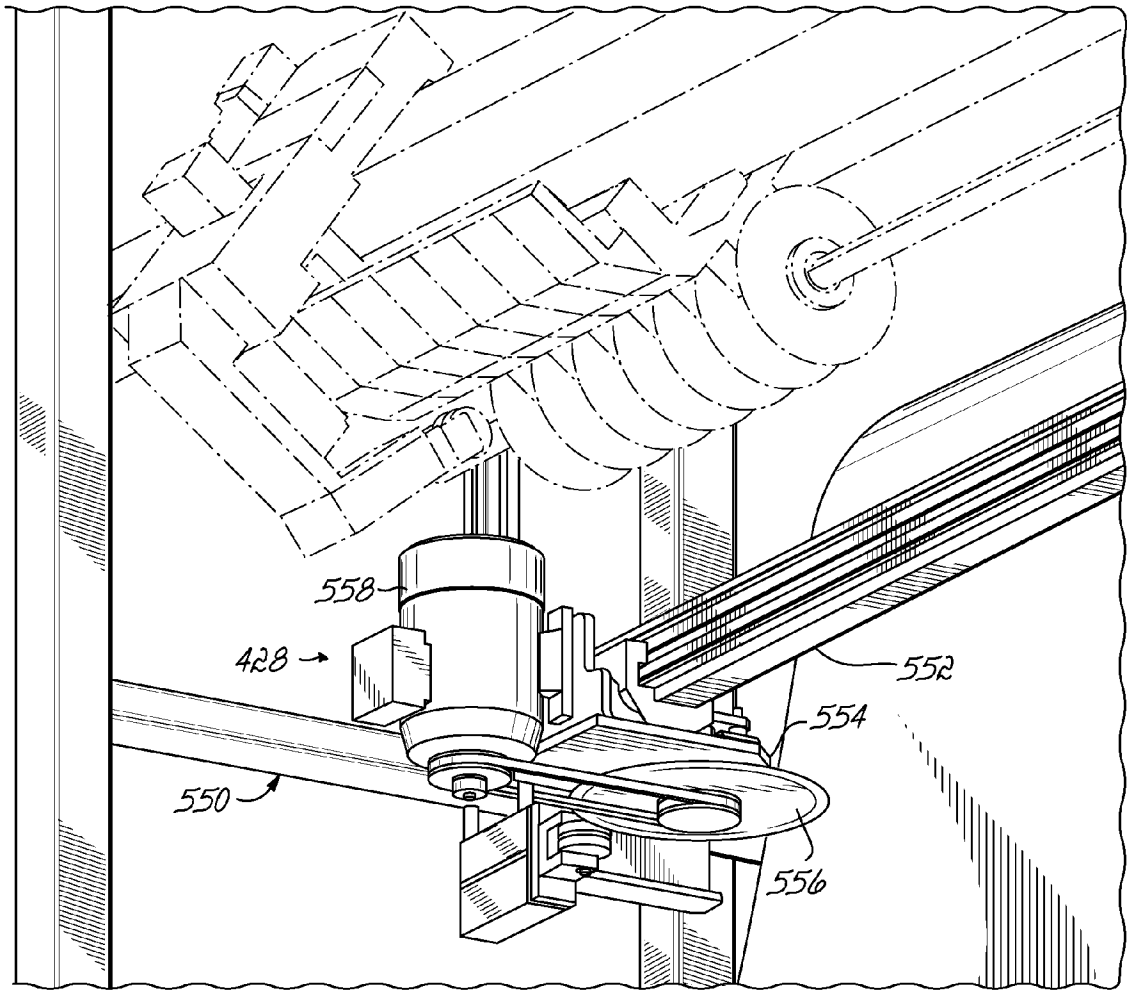
FIG. 37 is a perspective view of a portion of the cross cutter system of the programmable border slitter of FIGS. 27A and 27B.

Referring to FIG. 37, the cross cutter system 428 comprises a linear guide rail 552 that extends across a width of the border slitter 400 and is supported via a frame 550. A cross cutter carriage 554 is mounted on linear guide rail 552 and moves thereon. Cross cutter carriage 554 supports a rotatable cross cutter blade 556 rotatable via a cross cutter motor 558. The cross cutter system 428 is operable in a known manner to move the cross cutter blade 556 along the length of the guide rail 552, thereby cutting the material to a desired length. Any other similar known cross cutter system may be used if desired.

Figure 38:
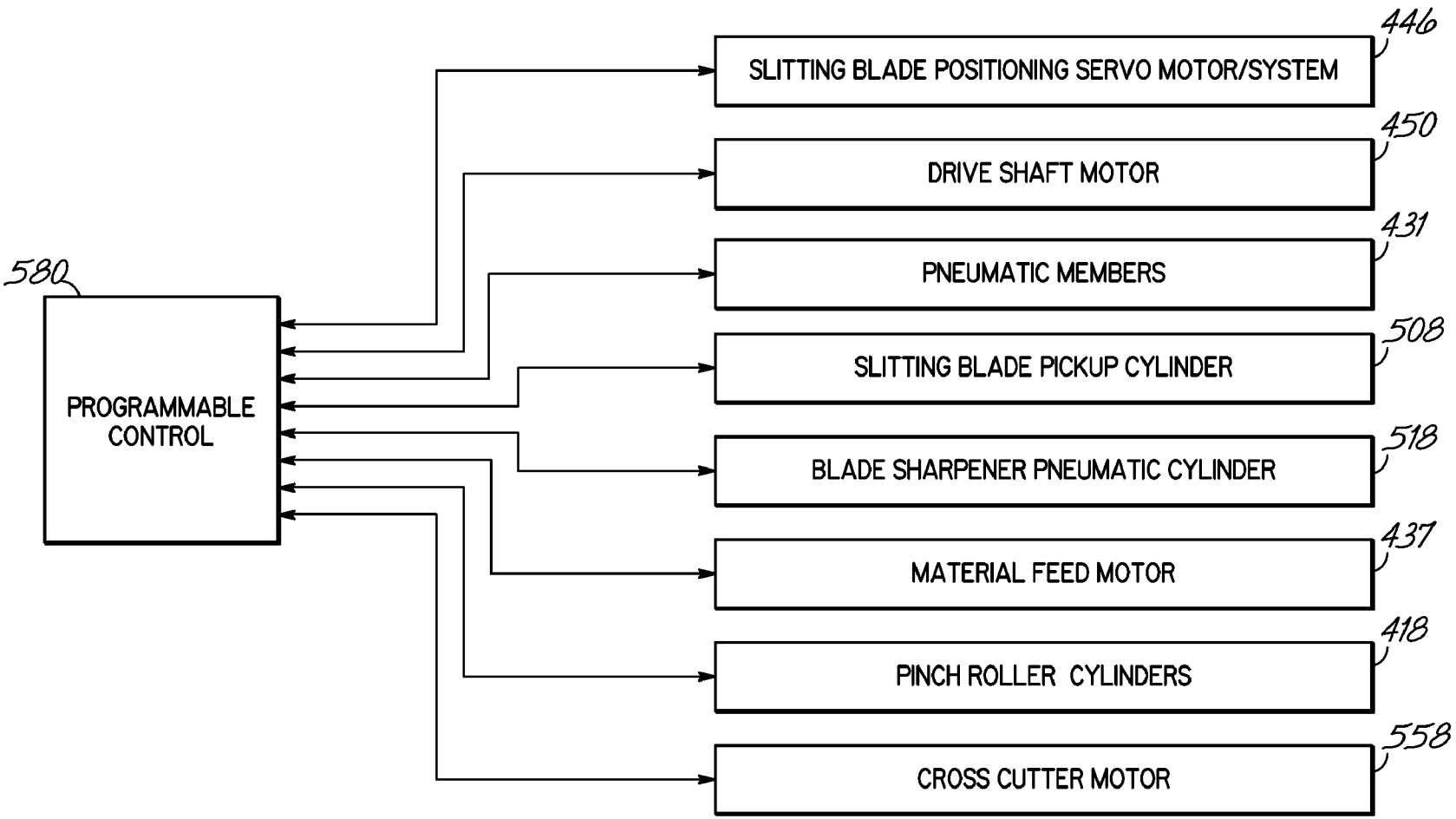
FIG. 38 is a schematic block diagram of a control circuit of the programmable border slitter of FIGS. 27A and 27B.

Referring to FIG. 38, a programmable control 580, like programmable control 180, is used to coordinate the operation of the various motors and cylinders on the programmable border slitter 400. For a particular set of border pieces to be slit, the programmable control 580 contains data relating to the widths of those border pieces; and it operable to move slitting blade assemblies 440 to desired positions on the support bar assembly 442 such that the desired widths of the border pieces will be slit.

Therefore, the invention in its broadest aspects is not limited to the specific details shown and described. Consequently, departures may be made from the details described herein without departing from the spirit and scope of the claims which follow.

What is claimed is:

1. An apparatus for feeding and slitting soft goods comprising:

a plurality of rollers adapted to carry the soft goods, the plurality of rollers comprising a feed roller and a pinch roller;

a cross rail extending generally parallel to but spaced from the plurality of rollers;

a plurality of slitting blade assemblies movably mounted on the cross rail, each of the slitting blade assemblies comprising a plurality of guide rollers and a plurality of metal cams and a slitting blade mounted on a rotatable drive shaft;

a motor for rotating the drive shaft;

a slitting blade positioning system movable in a direction parallel with the cross rail, the slitting blade positioning system being operable to identify and move one of the slitting blade assemblies to a desired position relative to the cross rail;

a material feed motor connected to the feed roller and operable to move the soft goods past the slitting blade assembly;

a control for operating the drive shaft motor, the slitting blade positioning system and the material feed motor, the control operable to cause the slitting blade positioning system to move the slitting blade assembly to a desired position on the cross rail, and the control being further operable to turn on the drive shaft motor and the material feed motor, thereby moving the soft goods past the slitting blade.

2. The apparatus of claim 1 wherein the cross rail comprises a length greater than a width of the soft goods, thereby permitting slitting blade assemblies to be moved to an end of the cross rail when not being used.

3. The apparatus of claim 1 wherein the slitting blade positioning system includes a carriage movable along the cross rail.

4. The apparatus of claim 3 wherein the carriage comprises a plurality of sensors operable to detect one of the slitting blade assemblies.

5. The apparatus of claim 3 wherein the carriage is driven by belt driven by a servo motor.

6. The apparatus of claim 3 wherein a blade sharpener is fixedly mounted on the carriage.

7. The apparatus of claim 1 wherein the slitting blade positioning system is operable by the control to first disengage thea locking device, thereby permitting the slitting blade positioning system to move the one slitting blade assembly along the cross rail to the desired position and thereafter, engage the locking device to lock the one slitting blade assembly at the desired position.

8. The apparatus of claim 7 wherein the locking device comprises a shaft movable into and out of contact with the cross rail.

9. The apparatus of claim 8 wherein the slitting blade positioning system comprises fingers movable by the control to first lift the shaft out of contact with the cross rail and thereafter, release the shaft.

10. The apparatus of claim 9 wherein the locking device further comprises a biasing device to push the shaft into engagement with the cross rail upon being released by the fingers.

11. The apparatus of claim 10 wherein the locking device comprises a cylinder operable by the control to engage and disengage the cross rail.

12. The apparatus of claim 1 further comprising:

a feed roller for supporting the soft goods; and a pinch roller mounted adjacent the feed roller and movable into and out of contact with the soft goods on the feed roller for moving the soft goods past the respective slitting blade.

13. The apparatus of claim 12 wherein the feed roller is connected to a feed motor.

14. The apparatus of claim 1 comprising a cross cutter system operably connected to the control for cutting the multiple pieces to a desired length.

15. An apparatus for feeding and slitting soft goods comprising:

a plurality of rollers adapted to carry the soft goods, the plurality of rollers comprising a feed roller and a pinch roller;

a cross rail extending generally parallel to, but spaced from, the plurality of rollers;

a plurality of slitting blade assemblies mounted for sliding motion on the cross rail, each of the slitting blade assemblies comprising a rotatable slitting blade rotatable with respect to the remainder of the slitting blade assembly and a plurality of cams;

a rotatable drive shaft mounted generally parallel to, but spaced from the cross rail, the drive shaft operably connected to the slitting blades blade assemblies;

a drive shaft motor operable to rotate the drive shaft and the slitting blades;

a slitting blade positioning system mounted on and movable in a direction parallel with the cross rail, the slitting blade positioning system being operable to move the slitting blade assemblies along the cross rail and thus, across a substantial width of the soft goods;

a material feed motor connected to the feed roller and operable to move the soft goods past at least some of the slitting blade assemblies;

a control for operating the motor, the slitting blade positioning system and the material feed motor, the control operable to cause the slitting blade positioning system to move the slitting blade assemblies to desired respective positions on the cross rail, and the control being further operable to turn on the drive shaft motor and the material feed motor, thereby moving the soft goods past the slitting blades.

16. The apparatus of claim 15 wherein the slitting blade positioning system includes a carriage movable along the cross rail.

17. The apparatus of claim 16 wherein the carriage comprises a plurality of sensors operable to detect one of the slitting blade assemblies.

18. The apparatus of claim 16 wherein the carriage is driven by belt driven by a servo motor.

19. An apparatus for feeding and slitting soft goods comprising:

a plurality of rollers adapted to carry the soft goods, the plurality of rollers comprising an engagement roller movable by a pair of pneumatic members;

a cross rail extending generally parallel to, but spaced from, the plurality of rollers;

slitting blade assemblies movable in a direction generally parallel to the cross rail, each of the slitting blade assemblies comprising a plurality of metal cams and having a rotatable slitting blade mounted on a drive shaft mounted on a drive shaft motor;

a slitting blade positioning system mounted on, and movable in a direction parallel with the cross rail, the slitting blade positioning system being operable to move the slitting blade assemblies over a substantial length of the cross rail and thus, a substantial width of the soft goods;

a material feed motor connected to one of the rollers and operable to move the soft goods past at least one of the slitting blade assemblies;

a control for operating the drive shaft motor, the slitting blade positioning system and the material feed motor, the control operable to cause the slitting blade positioning system to move the slitting blade assemblies to desired respective positions on the cross rail, and the control being further operable to turn on the drive shaft motor and the material feed motor, thereby moving the soft goods past the rotating slitting blades.

20. An apparatus for feeding and slitting soft goods comprising:

a plurality of rollers adapted to carry the soft goods;

a cross rail extending generally parallel to, but spaced from, the plurality of rollers;

slitting blade assemblies movable in a direction generally parallel to the cross rail, each of the slitting blade assemblies comprising a plurality of cams and having a rotatable slitting blade mounted on a drive shaft mounted on a drive shaft motor;

a slitting blade positioning system mounted on, and movable in a direction parallel with the cross rail, the slitting blade positioning system being operable to move the slitting blade assemblies over a substantial length of the cross rail and thus, a substantial width of the soft goods;

a material feed motor connected to one of the rollers and operable to move the soft goods past at least one of the slitting blade assemblies;

a control for operating the drive shaft motor, the slitting blade positioning system and the material feed motor, the control operable to cause the slitting blade positioning system to move the slitting blade assemblies to desired respective positions on the cross rail, and the control being further operable to turn on the drive shaft motor and the material feed motor, thereby moving the soft goods past the rotating slitting blades.

21. The apparatus of claim 20, the plurality of rollers comprising an engagement roller movable by a pair of pneumatic members.

22. The apparatus of claim 20 wherein the cross rail comprises a length greater than a width of the soft goods, thereby permitting some of the slitting blade assemblies to be moved to an end of the cross rail when not being used.

23. The apparatus of claim 20 wherein the slitting blade positioning system includes a carriage movable along the cross rail.

24. The apparatus of claim 22 wherein the carriage comprises a plurality of sensors operable to detect one of the slitting blade assemblies.

25. The apparatus of claim 22 wherein the carriage is driven by belt driven by a servo motor.

26. The apparatus of claim 20 wherein the slitting blade positioning system is operable by the control to first disengage a locking device, thereby permitting the slitting blade positioning system to move the one slitting blade assembly along the cross rail to the desired position and thereafter, engage the locking device to lock the one slitting blade assembly at the desired position.

27. The apparatus of claim 26 wherein the locking device comprises a shaft movable into and out of contact with the cross rail.

28. The apparatus of claim 27 wherein the slitting blade positioning system comprises fingers movable by the control to first lift the shaft out of contact with the cross rail and thereafter, release the shaft.

29. The apparatus of claim 28 wherein the locking device further comprises a biasing device to push the shaft into engagement with the cross rail upon being released by the fingers.

30. The apparatus of claim 28 wherein the locking device comprises a cylinder operable by the control to engage and disengage the cross rail.

31. The apparatus of claim 23 wherein a blade sharpener is fixedly mounted on the carriage.

32. The apparatus of claim 20 further comprising a cross cutter system operably connected to the control for cutting the multiple pieces to a desired length.

* * * * *

UNITED STATES PATENT AND TRADEMARK OFFICE

CERTIFICATE OF CORRECTION

PATENT NO. : 8,210,079 B2
APPLICATION NO. : 12/464457
DATED : July 3, 2012
INVENTOR(S) : Terrance L. Myers et al.

It is certified that error appears in the above-identified patent and that said Letters Patent is hereby corrected as shown below:

Column 1

Line 5, "of to U.S. Patent" should be --of U.S. Patent--.

Column 4

Line 37, insert a --,-- after "slitting system".

Column 7

Line 49, "guides rods" should be --guide rods--.

Line 52, "sharpen" should be --sharpener--.

Line 54, "sharpening" should be --sharpen--.

Column 8

Line 39, "it operable" should be --is operable--.

Column 9

Line 56, after "advantages", insert --of--.

Column 10

Line 12, "nor" should be --or--.

Column 15

Line 39, "rotatable" should be --rotatably--.

Line 50, "identify" should be --identifies--.

Signed and Sealed this
Twenty-eighth Day of August, 2012

David J. Kappos

David J. Kappos
*Director of the United States Patent and Trademark Office*

Column 17

Line 11, “guide rails” should be --guide rail--.

Line 61, “it operable” should be --is operable--.

Column 18

Line 47, delete “belt driven by”.

Line 52, “thea” should be --a--.

Column 19

Line 29, delete the word “blades”.

Lines 30-31, delete “and the slitting blades”.

Line 55, delete “by belt driven”.

Column 20

Line 57, delete “by belt driven”.